US006524784B2

(12) United States Patent
Hirabayashi

(10) Patent No.: US 6,524,784 B2
(45) Date of Patent: Feb. 25, 2003

(54) PHOTOTHERMOGRAPHIC MATERIAL

(75) Inventor: Kazuhiko Hirabayashi, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/033,072

(22) Filed: Dec. 26, 2001

(65) Prior Publication Data

US 2002/0123016 A1 Sep. 5, 2002

(30) Foreign Application Priority Data

Dec. 27, 2000 (JP) ..... 2000-396642

(51) Int. Cl.[7] ..... G03C 1/498
(52) U.S. Cl. ..... 430/619
(58) Field of Search ..... 430/619, 350, 430/512, 513, 568

(56) References Cited

U.S. PATENT DOCUMENTS 6,093,529 A * 7/2000 Tsuzuki et al. ..... 430/619
6,274,297 B1 * 8/2001 Uytterhoeven et al. ..... 430/350

* cited by examiner

*Primary Examiner*—Thorl Chea
(74) *Attorney, Agent, or Firm*—Bierman, Muserlian and Lucas

(57) ABSTRACT

A photothermographic material is disclosed, comprising on a suppot an organic silver salt, silver halide grains, a reducing agent, a contrast-increasing agent and a binder, wherein the photothermographic material has a residual organic solvent content of 30 to 500 mg/m$^2$ and exhibits a sensitivity maximum at a wavelength of 350 to 450 nm. an image forming method is also disclosed, comprising exposing the photothermographic material to light using a light source having emission within the wavelength region of 350 to 450 nm.

12 Claims, No Drawings

PHOTOTHERMOGRAPHIC MATERIAL

FIELD OF THE INVENTION

The present invention relates to photothermographic materials and an image forming method, and in particular to photothermographic materials suitable for use in printing plate making and an image forming method by use thereof.

BACKGROUND OF THE INVENTION

In the field of graphic arts and medical treatment, there have been concerns in processing of photographic film with respect to effluents produced from wet-processing of image forming materials, and recently, reduction of the processing effluent is strongly demanded in terms of environmental protection and space saving. There has been desired a photothermographic material for photographic use, capable of forming distinct black images exhibiting high sharpness, enabling efficient exposure by means of a laser imager or a laser image setter. Known as such a technique is a thermally developable photothermographic material which comprises on a support an organic silver salt, light sensitive silver halide grains, and reducing agent, as described in U.S. Pat. Nos. 3,152,904 and 3,487,075, and D. Morgan, "Dry Silver Photographic Materials" (Handbook of Imaging Materials, Marcel Dekker, Inc. page 48, 1991).

Such a photothermographic material contains a reducible light-insensitive silver source (such as organic silver salts), a light-sensitive silver halide and a reducing agent, which are dispersed in a binder matrix. The photothermographic materials are stable at ordinary temperature and forms silver upon heating, after exposure, at a relatively high temperature (e.g., 80° C. to 140° C.) through an oxidation-reduction reaction between the reducible silver source (which functions as an oxidizing agent) and the reducing agent. The oxidation reduction reaction is accelerated by catalytic action of a latent image produced by exposure. Silver formed through reaction of the reducible silver salt in exposed areas provides a black image, which contrasts with non-exposes areas, leading to image formation. Such photothermographic materials meet requirements for simplified processing and environmental protection.

Such photothermographic materials have been mainly employed as photographic materials mainly for use in micrography and medical radiography, but partly for use in graphic arts. This is due to the fact that the maximum density (also denoted as Dmax) of obtained images is still low and the contrast is relatively low so that desired quality levels for graphic arts have not yet been achieved. To overcome such problems, there have been attempted incorporation of hydrazine derivatives as a contrast-increasing agent into the photothermographic material to form high contrast halftone dot images but satisfactory levels have not yet achieved. In general, when the foregoing contrast-increasing agent promotes thermal development of the halftone dot-exposed photothermographic material, halftone dots often tend to be abruptly formed so that intermediate-size and large-size dots become larger than intended their dot sizes, leading to deteriorated linearity of halftone dot images.

In the laser image setter described above, coherent light such as green laser of 500 to 600 nm and long wave laser having an emission wavelength in the near-infrared region are usually employed so that photothermographic materials used therein contain sensitizing dyes sensitive to such light are employed in the photothermographic material. After subjected to thermal processing, the sensitizing dyes remain on the halftone dot images, producing problems that dot image quality or linearity is lowered, resulting to so-called deterioration due to remaining dye stain. It was found that the use of recently developed short wave laser having an emission at 350 to 450 nm to halftone dot images on the photothermographic material resulted in superior images to those obtained by commonly known long wave laser, without causing dye stains. However, satisfactory levels were not necessarily attained.

SUMMARY OF THE INVENTION

In view of the foregoing facts, the present invention was achieved. Thus, it is an object of the invention to provide a photothermographic material exhibiting superior halftone dot quality, an enhanced maximum density and superior linearity and forming high contrast images, without causing dye stain, and an image forming method by the use thereof.

The above object of the invention can be achieved by the following constitution:

1. A photothermographic material comprising on a support an organic silver salt, silver halide grains, a reducing agent, a contrast-increasing agent and a binder, which has been prepared by using an organic solvent as a main solvent in coating, wherein the photothermographic material has a residual organic solvent content of 30 to 500 mg/m$^2$ and exhibits a sensitivity maximum at a wavelength of 350 to 450 nm; and 2. An image forming method comprising exposing the photothermographic material described above to light using a light source having a maximum emission within the wavelength region of 350 to 450 nm.

Furthermore, preferred effects of the invention were achieved by the following embodiments.

3. The photothermographic material described in 1, wherein the silver halide grains have an average grain size of not more than 0.03 $\mu$m;

4. The photothermographic material described in 1 or 2, wherein the photothermographic material comprises a compound represented by the following formula (I) to (III):

formula (I)

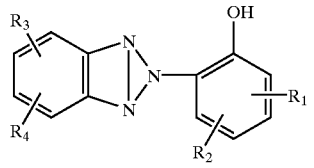

wherein $R_1$ through $R_4$ are each a hydrogen atom, halogen atom, nitro group, hydroxy group, alkyl group, alkoxy group, aryl group, aryloxy group, acylamino group, carbamoyl group, sulfo group, alkylthio group or arylthio group, provided that $R_1$ and $R_2$, or $R_3$ and $R_4$ may combine with each other to form a ring, and $R_1$ through $R_4$ may be substituted by any substituent group;

formula (II)

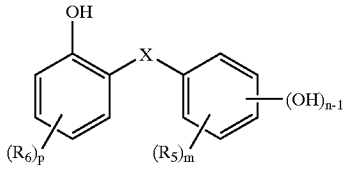

wherein $R_5$ and $R_6$ are each a hydrogen atom, alkyl group or acyl group; X is —CO— or —COO—; m, n and p are each an integer of 1 to 4, $R_5$ and $R_6$ may be substituted by any substituent group;

formula (III)

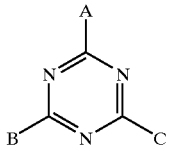

wherein A, B and C are each a substituted or unsubstituted alkyl group, aryl group, alkoxy group, aryloxy group or heterocyclic group, provided that at least one of A, B and C is represented by the following formula (IV):

formula (IV)

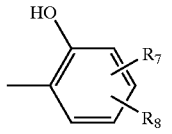

wherein $R_7$ and $R_8$ are each a hydrogen atom, or a substituted or unsubstituted alkyl group, aryl group, alkoxy group or aryloxy group; and 5. The image forming method described in 2, wherein the light is incoherent light.

DETAILED DESCRIPTION OF THE INVENTION

Photothermographic Material

The thermally developable photothermographic material relating to the invention (hereinafter, also denoted simply as photothermographic material) comprises on a support a light-sensitive silver halide layer and a light-insensitive layer, the light-sensitive layer containing a hydrophilic or hydrophobic binder, an organic silver salt, silver halide grains, a reducing agent and a contrast-increasing agent; and such ingredient compounds are dissolved or dispersed in an organic solvent or water, and preferably an organic solvent as a main solvent and coated on the support such as PET (i.e., polyethylene terephthalate) to obtain the photothermographic material. The photothermographic material preferably contains a UV absorbent.

Binder

Binders suitable for the light-sensitive layer or light-insensitive layer of the photothermographic material relating to the invention is are transparent or translucent, and generally colorless. The binders are natural polymers, synthetic resins, and polymers and copolymers, other film forming media; Examples thereof include gelatin, gum arabic, poly (vinyl alcohol), hydroxyethyl cellulose, cellulose acetate, cellulose acetatebutylate, poly(vinyl pyrrolidone), casein, starch, poly(acrylic acid), poly(methyl methacrylic acid), poly(vinyl chloride), poly(methacrylic acid), copoly (styrene-maleic acid anhydride), copoly(styrene-acrylonitrile, copoly(styrene-butadiene, poly(vinyl acetal) series [e.g., poly(vinyl formal)and poly(vinyl butyral), polyester series, polyurethane series, phenoxy resins, poly (vinylidene chloride), polyepoxide series, polycarbonate series, poly(vinyl acetate) series, cellulose esters, poly (amide) series. The binders used in the invention may be hydrophilic binders or hydrophobic binders and hydrophobic binder are preferable to minimize fogging produced after thermal development. Preferred binders are polyvinyl butyral, cellulose acetate, cellulose acetate-butylate, polyester, polycarbonate, polyacrylic acid, and polyurethane. Of these, are preferred polyvinyl butyral, cellulose acetate, cellulose acetate-butylate and polyester. As described above, the use of hydrophobic transparent binder is preferred and water-soluble or water-dispersible resin may optionally be used in combination.

Organic Silver Salt

Organic silver salts contained in the light-sensitive layer of the photothermographic material are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which has a total stability constant to a silver ion of 4.0 to 10.0 are preferred. Exemplary preferred complex salts are described in Research Disclosure (hereinafter, also denoted as RD) 17029 and RD29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1,2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver behenate, silver arachidate and silver stearate are specifically preferred.

The organic silver salt compound can be obtained by mixing an aqueous-soluble silver compound with a compound capable of forming a complex. Normal precipitation, reverse precipitation, double jet precipitation and controlled double jet precipitation described in JP-A 9-127643 are preferably employed (hereinafter, the term, JP-A refers to unexamined and published Japanese Patent Application). For example, to an organic acid is added an alkali metal hydroxide (e.g., sodium hydroxide, potassium hydroxide, etc.) to form an alkali metal salt soap of the organic acid (e.g., sodium behenate, sodium arachidate, etc.), thereafter, the soap and silver nitrate are mixed by the controlled double jet method to form organic silver salt crystals. In this case, silver halide grains may be concurrently present.

Silver Halide Grain

Silver halide grains contained in the light-sensitive layer of the photothermographic material functions as a light sensor. In order to minimize cloudiness after image formation and to obtain excellent image quality, the less the average grain size, the more preferred, and the average grain size is preferably not more than 0.03 μm, and more preferably between 0.01 and 0.03 μm. The silver halide grains are preferably prepared simultaneously in the preparation of organic silver salts. It is also preferred that silver halide grains are prepared together with organic silver salt, forming silver halide grains fixed on organic silver salt grains and resulting in minute grains, so-called in situ silver. Electronmicrographs of at least 100 silver halide grains are taken at a factor of 50000 to determine the average grain size. Thus, the longest edge length and the shortest edge length of the grain are determined for 100 grains and the summation thereof divided by 200 is defined as the average grain size in the invention.

The average grain size as described herein is defined as an average edge length of silver halide grains, in cases where they are so-called regular crystals in the form of cube or octahedron. Furthermore, in cases where grains are not regular crystals, for example, spherical, cylindrical, and tabular grains, the grain size refers to the diameter of a sphere having the same volume as the silver grain. Furthermore, silver halide grains are preferably monodisperse grains. The monodisperse grains as described herein refer to grains having a monodispersibility (i.e., coefficient of variation of grain size distribution, as defined below) of not more than 40%; more preferably not more than 30%, still more preferably not more than 20%, and most preferably 0.1 to 20%:

Monodispersibility=(standard deviation of grain size)/(average grain size)×100(%)

Silver halide grains used in the invention preferably exhibit an average grain size of not more than 0.1 μm, preferably not more than 0.03 mm, and more preferably 0.01 to 0.03 μm, and monodisperse grains are still more preferred. The use of silver halide grains falling within such a grain size range leads to enhanced image graininess.

The silver halide grain shape is not specifically limited, but a high ratio accounted for by a Miller index [100] plane is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

Furthermore, another preferred silver halide shape is a tabular grain. The tabular grain as described herein is a grain having an aspect ratio represented by r/h of at least 3, wherein r represents a grain diameter in μm defined as the square root of the projection area, and h represents thickness in μm in the vertical direction. Of these, the aspect ratio is preferably between 3 and 50. The grain diameter is preferably not more than 0.1 μm, and is more preferably between 0.01 and 0.08 μm. These are described in U.S. Pat. Nos. 5,264,337, 5,314,789, 5,320,958, and others. In the present invention, when these tabular grains are used, image sharpness is further improved. The composition of silver halide may be any of silver chloride, silver chlorobromide, silver iodochlorobromide, silver bromide, silver iodobromide, or silver iodide.

Silver halide emulsions used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964).

Silver halide preferably occludes ions of metals belonging to Groups 6 to 11 of the Periodic Table. Preferred as the metals are W; Fe, Co, Ni, Cu, Ru, Rh, Pd, Re, Os, Ir, Pt and Au. These metals may be introduced into silver halide in the form of a complex.

Silver halide grain emulsions used in the invention may be desalted after the grain formation, using the methods known in the art, such as the noodle washing method and flocculation process.

The photosensitive silver halide grains used in the invention is preferably subjected to a chemical sensitization. As preferable chemical sensitizations, commonly known chemical sensitizations in this art such as a sulfur sensitization, a selenium sensitization and a tellurium sensitization are usable. Furthermore, a noble metal sensitization using gold, platinum, palladium and iridium compounds and a reduction sensitization are available.

In order to minimize haze (or cloudiness) of the recording material, the total silver coverage including silver halide grains and organic silver salts is preferably 0.3 to 2.2 g/m$^2$, and more preferably 0.5 to 1.5 g/m$^2$. Such a silver coverage forms a relatively high contrast image. The silver halide amount is preferably not more than 50% by weight, and more preferably not more than 25% by weight, and still more preferably 0.1 to 15% by weight, based on the total silver amount.

The silver halide grains used in the invention preferably exhibit the maximum absorption (so-called absorption maximum) at 350 to 450 nm, which may spectrally be sensitized with sensitizing dyes.

Further, the photothermographic material according to the invention exhibits a sensitivity maximum at a wavelength of 350 to 450 nm. The sensitivity maximum can be determined by subjecting a photothermographic material to absorption spectroscopy using an integrating sphere comprised of KBr. The sensitivity maximum at a wavelength of 350 to 450 nm refers to the absorption maximum being within the range of 350 to 450 nm.

Reducing Agent

Reducing agents are incorporated into the photothermographic material of the present invention. Examples of suitable reducing agents are described in U.S. Pat. Nos. 3,770,448, 3,773,512, and 3,593,863, and Research Disclosure Items 17029 and 29963, and include the following: aminohydroxycycloalkenone compounds (for example, 2-hydroxypiperidino-2-cyclohexane); esters of amino reductones as the precursor of reducing agents (for example, piperidinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl) methylsulfone); sulfydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones. Of these, particularly preferred reducing agents are hindered phenols.

As preferred hindered phenols, listed are compounds represented by the general formula (A) described below:

formula (A)

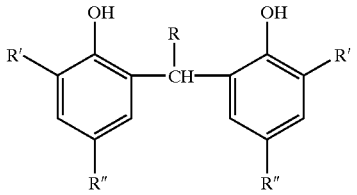

wherein R represents a hydrogen atom or an alkyl group having from 1 to 10 carbon atoms (for example, isopropyl, —$C_4H_9$, 2,4,4-trimethylpentyl), and R' and R" each represents an alkyl group having from 1 to 5 carbon atoms (for example, methyl, ethyl, t-butyl).

Exemplary examples of the compounds represented by the formula (A) are shown below.

A-1

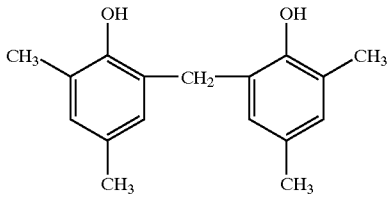

A-2

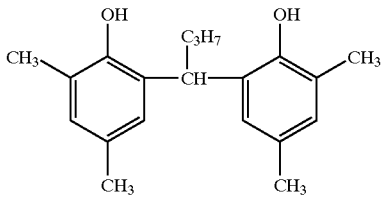

A-3

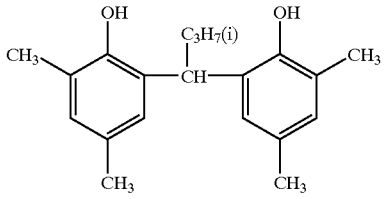

A-4

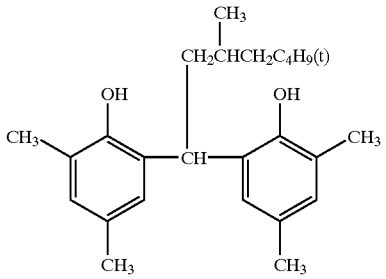

-continued

A-5

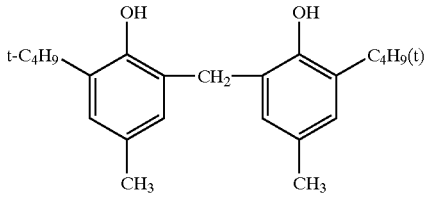

A-6

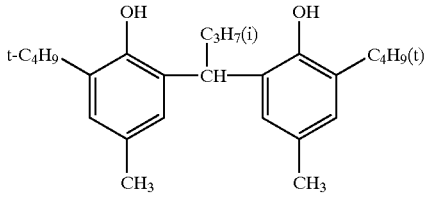

A-7

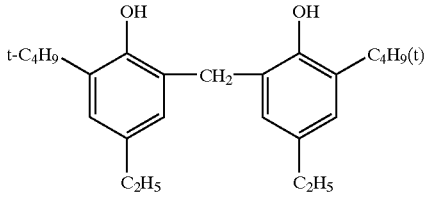

The used amount of reducing agents represented by the above-mentioned general formula (A) is preferably from $1\times10^{-2}$ to 10 moles, and is more preferably from $1\times10^{-2}$ to 1.5 moles per mole of silver.

Contrast-increasing Agent

The contrast increasing agent contained in the light-sensitive layer of the photothermographic material is preferably hydrazine compounds. Exemplary hydrazine compounds usable in the invention include those described in Research Disclosure Item 23515 (November, 1983, page 346) and references cited therein; U.S. Pat. Nos. 4,080,207, 4,269,929, 4,276,364, 4,278,748, 4,385,108, 4,459,347, 4,478,928, 4,560,638,, 4,686,167, 1912,016, 4,988,604, 4,994,365, 5,041,355, and 5,104,769; British Patent No. 2,011,391B, European Patent Nos. 217,310, 301,799 and 356,898; JP-A Nos. 60-179434, 61-170733, 61-270744, 62-178246, 62-270948, 63-29751, 63-32538, 63-194947, 63-121838, 63-129337, 63-223744, 63-234244, 63-234245, 63-234246, 63-294552, 63-306438, 64-10233, 1-90439, 1-100530, 1-105941, 1-105943, 1-276128, 1-280747, 1-283548, 1-28283549, 1-285940, 2-2541, 2-77057, 2-139538, 2-196234, 2-196235, 2-198440, 2-198441, 2-198442, 2-220042, 2-221953, 2-221954, 2-285342, 2-285343, 2-302750, 2-304550, 3-37642, 3-54549, 3-125134, 3-184039, 3-240036, 3-240037, 3-259240, 3-280038, 3-282536, 4-51143, 4-56842, 4-84134, 2-230233, 4-96053, 4-216544, 5-45761, 5-45762, 5-45763, 5-45764, 5-45765, 6-289524, and 9-160164.

Examples of the contrast-increasing agent further include compounds represented by (chemical formula 1) described in JP-B 6-77138, including compounds at page 3 to 4 (hereinafter, the term, JP-B refers to published Japanese Patent); compounds represented by formula (1), described in JP-B No. 6-93082, including compound No. 1 through 38 described at page 8 to 18; compounds represented by formulas (4), (5) and (6), described in JP-A No. 6-23049, including compounds 4-1 through 4-10 described at page 25 to 26, and compounds 5-1 through 5-42 described at page 28 to 36, and compounds 6-1 through 6-7 described at page 39 and 40; compounds represented by formula (1) and (2), described in JP-A No. 6-289520, including compounds 1-1)

through 1-17) and 2-1) described at page 5 to 7; compounds represented by (chemical formula 2) and (chemical formula 3), described in JP-A 6-313936, including compounds described at page 6 to 19; compounds represented by (chemical formula 1) described in 6-313951, including compounds described at page 3 to 5; compounds represented by formula (I) described in JP-A No. 7-5610, including compounds I-1 through I-38; compounds represented by formula (II) described in JP-A 7-77783, including compounds described at page 10 to 27; and compounds represented by formula (H) and (Ha) described in JP-A 7-104426, including compounds H-1 through H-44 described at page 8 to 15.

Preferred contrast-increasing agents used in the invention include those described in JP-A No. 11-316437 at page 33 to 53, and more preferred compounds are those described in JP-A 12-298327 at page 17 to 25, represented by the following formulas:

C-1

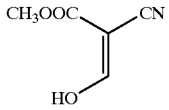

C-2

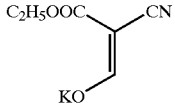

C-3

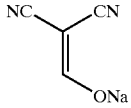

C-4

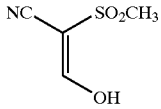

C-5

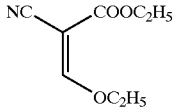

C-6

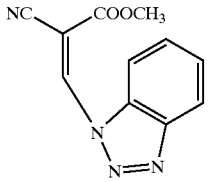

C-7

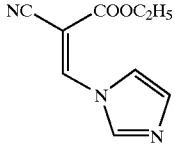

C-8

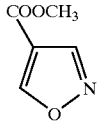

-continued

C-9

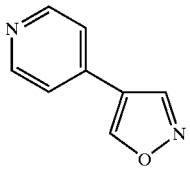

C-10

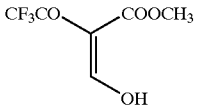

C-11

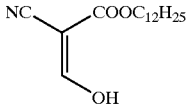

C-12

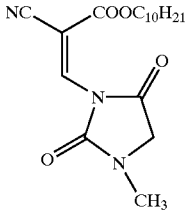

C-13

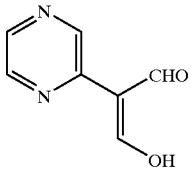

C-14

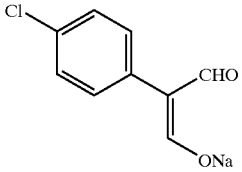

C-15

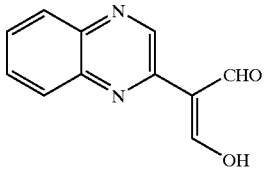

C-16

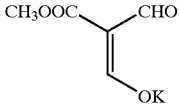

C-17

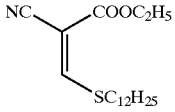

C-18

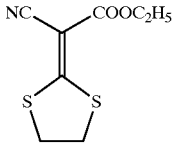

-continued
C-19
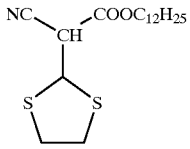
C-20
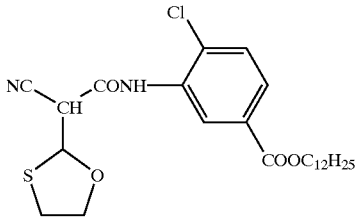
C-21
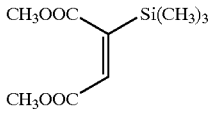
C-22
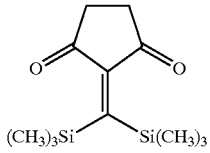
C-23
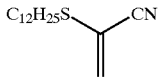
C-24
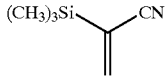
C-25
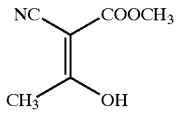
C-26
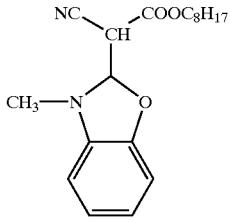
C-27
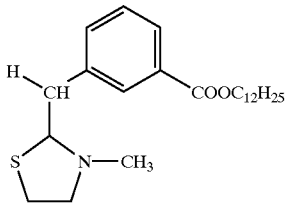
-continued
C-28
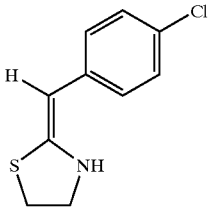
C-29
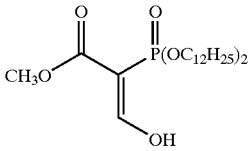
C-30
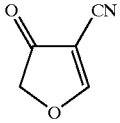
C-31
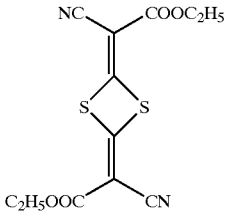
C-32
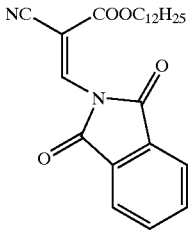
C-33
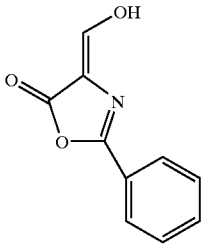
C-34
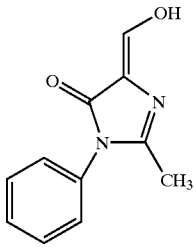

-continued
C-35
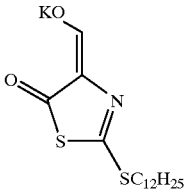
C-36
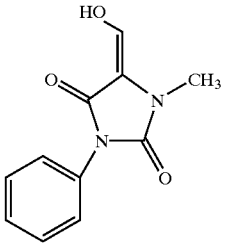
C-37
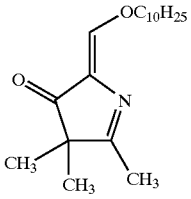
C-38
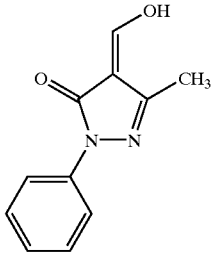
C-39
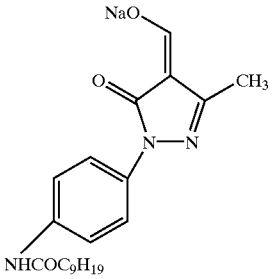
C-40
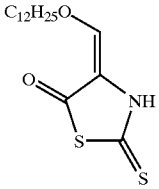
C-41
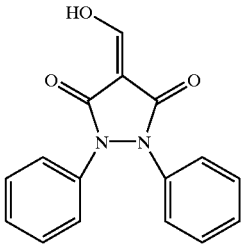
-continued
C-42
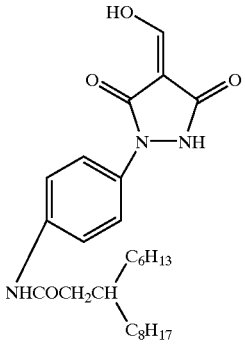
C-43
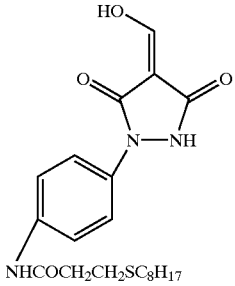
C-44
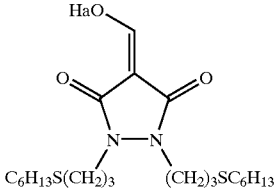
C-45
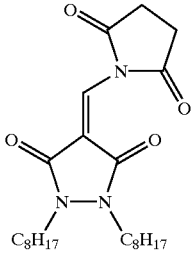
C-46
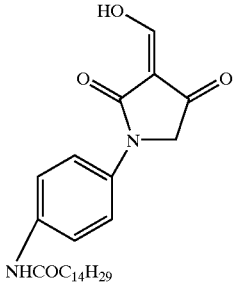
C-47
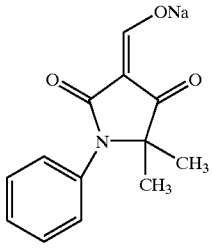

-continued
C-48
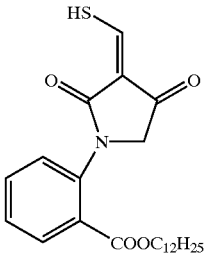
C-49
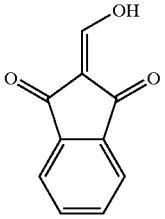
C-50
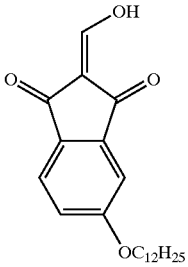
C-51
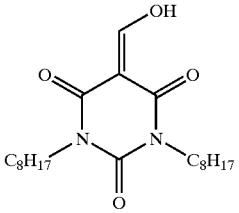
C-52
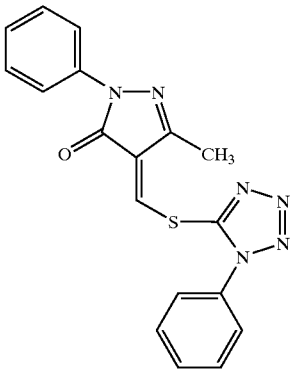
C-53
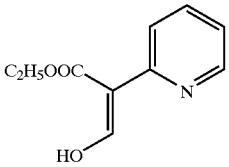
C-54
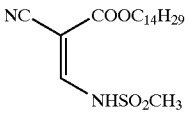
-continued
C-55
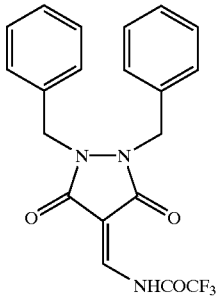
C-56
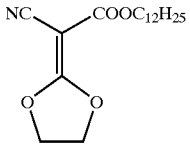
C-57
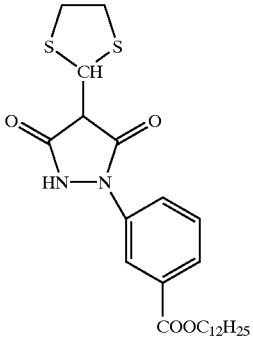
C-58
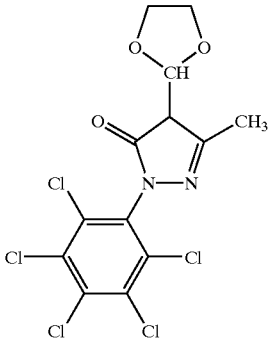
C-59
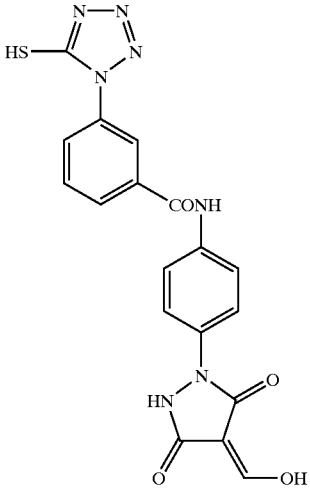

-continued

C-60

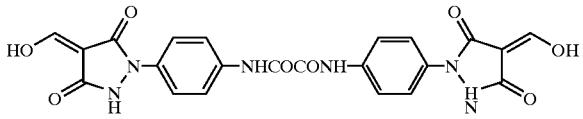

C-61

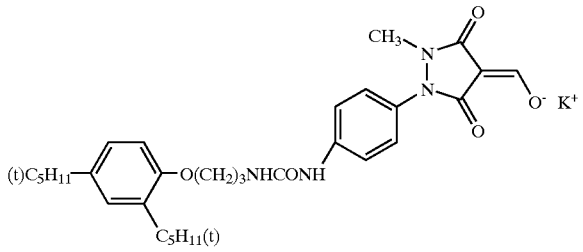

C-62

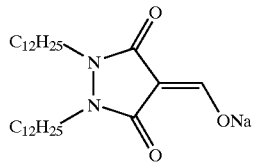

C-63

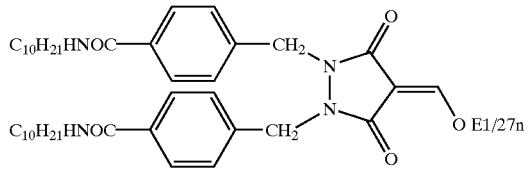

C-64

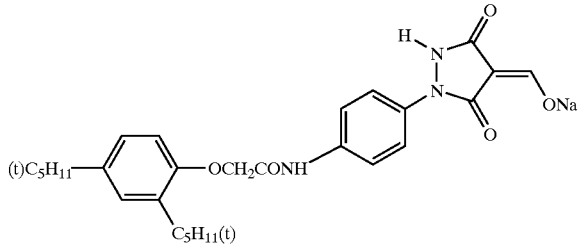

UV Absorbent

Next, the UV absorbent represented by formula (I), (II) or (III), contained in the photothermographic material relating to the invention will be described.

In formula (I), $R_1$ through $R_4$ each represent a hydrogen atom, halogen atom, nitro group, hydroxy group, alkyl group, alkoxy group, aryl group, aryloxy group, acylamino group, carbamoyl group, sulfo group, alkylthio group or arylthio group, provided that $R_1$ and $R_2$, or $R_3$ and $R_4$ may combine with each other to form a ring. In formula (II), $R_5$ and $R_6$ each represent a hydrogen atom, alkyl or acyl group; X represents —C═ or —COO—; m, n and p are each an integer of 1 to 4. These substituent groups represented in formula (I) or (II) may be further substituted by any substituent group. 2-(2'-hydroxyphenyl)benzotriazole type UV absorbents used in the invention are liquid at ordinary temperature. Such liquids are exemplarily described in JP-B Nos. 55-36984 and 55-12587 and JP-A No. 214152. The atoms or groups represented by $R_1$ through $R_4$ in formula (I) are detailed in JP-A Nos. 58-221844, 59-46646, 59-109055; JP-B Nos. 36-10466, 42-26187, 48-5496, and 48-41572; U.S. Pat. Nos. 3,754,919 and 4,220,711. The groups represented by $R_5$ and $R_6$ in benzophenone type UV absorbents, represented by formula (II) are detailed in JP-B No. 48-30493 (or U.S. Pat. No. 3,698,907) and JP-B No. 48-31255.

In formula (III), A, B and C independently represent a substituted or unsubstituted alkyl group (preferably having 1 to 20 carbon atoms), aryl group, alkoxy group, aryloxy group or heterocyclic group (e.g., pyridyl). Examples of a substituent group include hydroxy, a halogen atom (e.g., fluorine, chlorine, bromine), alkyl group having 1 to 12 carbon atoms (e.g., methyl ethyl, butyl, trifluoromethyl, hydroxyoctyl, epoxymethyl), alkoxy group having 1 to 18 carbon atoms (e.g., methoxy, ethoxy, butoxy, cyclohexyloxy, benzoyloxy), aryloxy group having 6 to 18 carbon atoms (e.g., phenoxy, m-methylphenoxy), alkoxycarbonyl group (e.g., ethoxycarbonyl, 2-methoxyethoxycarbonyl), aryloxycarbonyl group (e.g., phenoxycarbonyl, p-methylphenoxycarbonyl), alkylthio group having 1 to 18 carbon atoms (e.g., methylthio, butylthio) and carbamoyl group (e.g., methylcarbamoyl, butylcarbamoyl). Of the groups represented by A, B and C, the group, other than the group represented by formula (IV), is preferably a substituted or unsubstituted aryl or alkoxy group.

$R_7$ and $R_8$ in formula (IV) independently represent a halogen atom (e.g., fluorine, chlorine, bromine), alkyl group having 1 to 18 carbon atoms (e.g., methyl, trifluoromethyl, cyclohexyl, glycidyl), substituted or unsubstituted aryl group having 6 to 18 carbon atoms (e.g., phenyl, tolyl), substituted or unsubstituted alkoxy group (e.g., methoxym butoxy, 2-butoxyethoxy, 3-butoxy-2-hydoxypropyloxy), and substituted or unsubstituted aryloxy group having 6 to 18 carbon atoms (e.g., phenoxy, p-methylphenoxy). $R_7$ and $R_8$ are preferably an alkoxy group having 1 to 20 carbon atoms, in which a substituent group is substituted preferably at the para-position to the carbon atom attached to the triazine ring.

The compound represented by formula (III) can be synthesized in accordance with the method described in JP-A No. 46-3335 or European Patent No. 520938A1. Examples of UV absorbents usable in the invention are shown below but are by no means limited to these examples.

Compound of Formula (I)

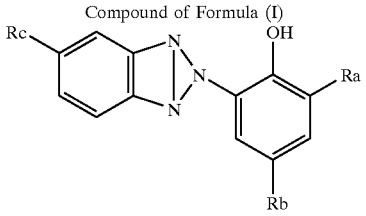

| No. | Rc | Ra | Rb |
|---|---|---|---|
| I-1 | H | H | —$C_4H_9$(t) |
| I-2 | H | H | —$C_{12}H_{25}$(n) |
| I-3 | H | H | —$CH_2CH_2COOC_8H_{17}$ |
| I-4 | Cl | H | —$C_8H_{17}$(t) |
| I-5 | Cl | H | —$CH_2CH_2COOC_8H_{17}$ |
| I-6 | H | —$C_4H_9$(sec) | —$C_4H_9$(t) |
| I-7 | H | —$C_5H_{11}$(t) | —$C_5H_{11}$(t) |
| I-8 | H | —$C_4H_9$(t) | —$CH_2CH_2COOC_8H_{17}$ |
| I-9 | H | —$CH_3$ | —$C_4H_9$(t) |
| I-10 | Cl | —$C_4H_9$(t) | —$C_4H_9$(t) |
| I-11 | Cl | —$C_4H_9$(sec) | —$C_4H_9$(t) |
| I-12 | Cl | —$C_4H_9$(t) | —$CH_2CH_2COOC_8H_{17}$ |
| I-13 | —$OCH_3$ | —$C_4H_9$(sec) | —$C_4H_9$(t) |
| I-14 | —$C_4H_9$(sec) | —$C_4H_9$(t) | —$CH_2CH_2COOC_8H_{17}$ |
| I-15 | —$C_6H_5$ | —$C_5H_{11}$(t) | —$C_5H_{11}$(t) |
| I-16 | H | —$C_{12}H_{25}$(n) | —$CH_3$ |
| I-17 | H | —$C_4H_9$(t) | —$C_4H_9$(t) |

-continued

Compound of Formula (I)

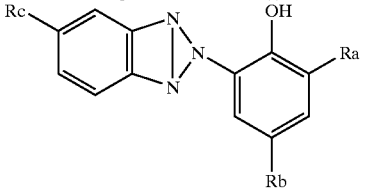

| No. | Rc | Ra | Rb |
|---|---|---|---|
| I-18 | H | H | —$CH_2CH_2COOC_8H_{17}$ |
| I-19 | —$OCH_3$ | —$C_{12}H_{25}$(n) | —$CH_3$ |
| I-20 | Cl | —$C_4H_9$(t) | —$CH_2CH_2COOC_8H_{17}$ |

Compound of Formula (II)

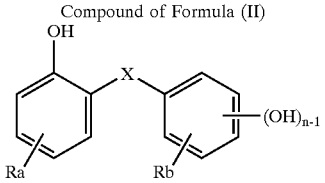

| No. | $X_3$ | Ra | Rb | n | OH (position) |
|---|---|---|---|---|---|
| II-1 | —CO— | 5-$OC_4H_9$ | H | 1 | |
| II-2 | —CO— | 5-$OC_8H_{17}$ | H | 1 | |

-continued

Compound of Formula (II)

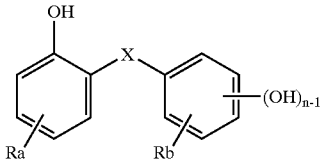

| No. | $X_3$ | Ra | Rb | n | OH (position) |
|---|---|---|---|---|---|
| II-3 | —CO— | 5-$OC_{16}H_{33}$ | H | 1 | |
| II-4 | —CO— | 5-$OC_{18}H_{37}$ | H | 1 | |
| II-5 | —CO— | 4-$OC_4H_9$ | 4'-$CH_3$ | 3 | 2'-, 5'- |
| II-6 | —CO— | 5-$COCH_3$ | 3'-$C_8H_{17}$ | 3 | 2'-, 6'- |
| II-7 | —CO— | 5-$C_{12}H_{25}$ | 4'-$COCH_3$ | 2 | 2'-, |
| II-8 | —CO— | 5-$COCH_3$ | 3'-$C_8H_{17}$ | 3 | 2'-, 6'- |
| II-9 | —CO— | 4-$OC_{12}H_{25}$ | 4'-$OCH_2C_6H_4$-(p)$CH_3$ | 2 | 2'- |
| II-10 | —CO— | 5-$C_8H_{17}$ | 4'-$COC_6H_4$-(p)$CH_3$ | 3 | 2'-, 6'- |
| II-11 | —COO— | 4-$C_{12}H_{25}$ | 4'-$C_4H_9$(t) | 1 | |
| II-12 | —COO— | H | 4'-$C_4H_9$(t) | 1 | |
| II-13 | —COO— | 4-$OC_{12}H_{25}$ | 5'-$OCH_3$ | 2 | 2'- |
| II-14 | —COO— | 3-$OCH_3$ | 5'-$OC_{12}H_{25}$ | 2 | 2'- |

III-1

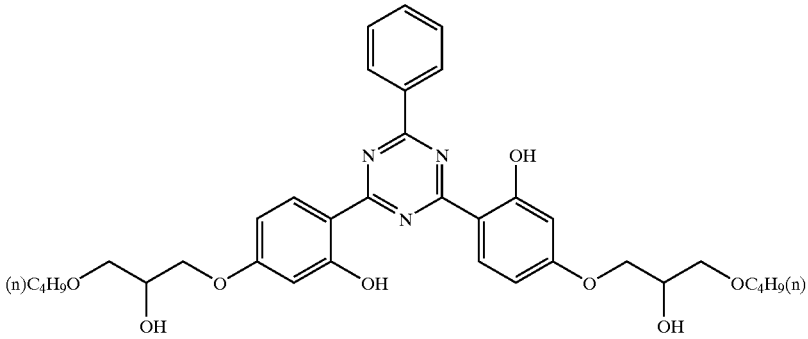

III-2

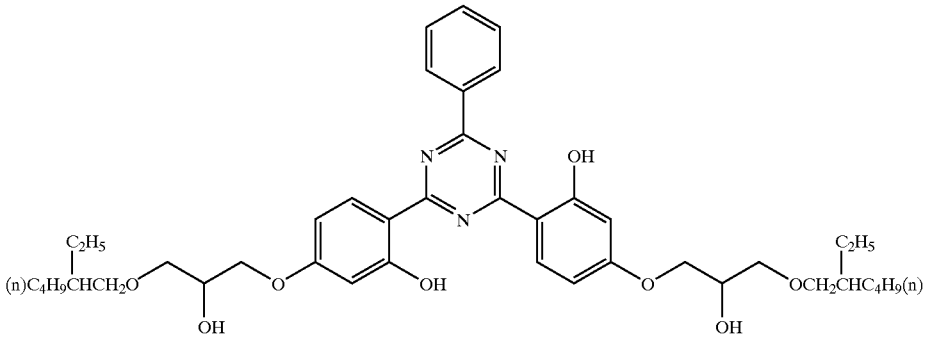

-continued
III-3
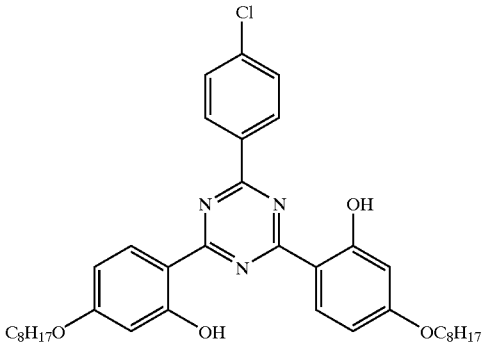
III-4
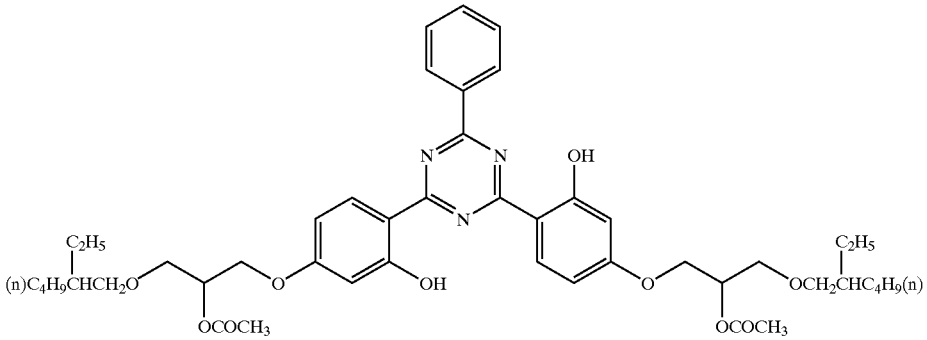
III-5
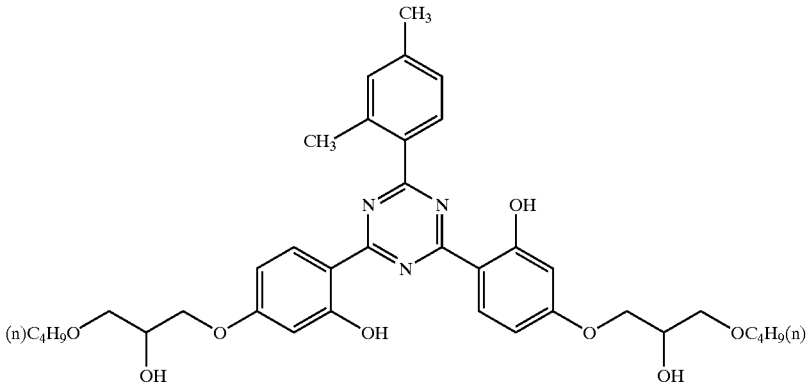
III-6
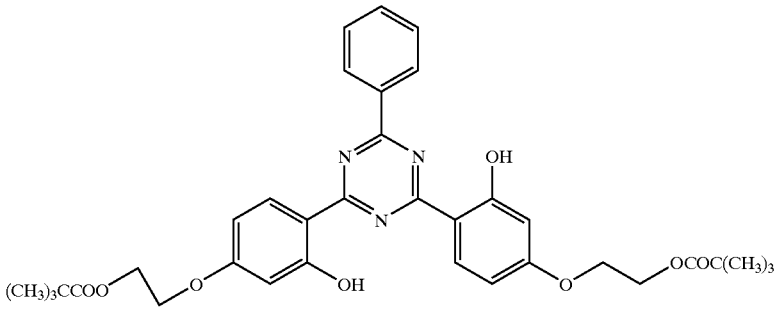
III-7
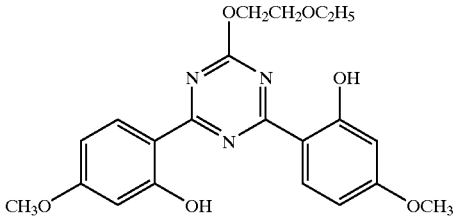

-continued
III-8
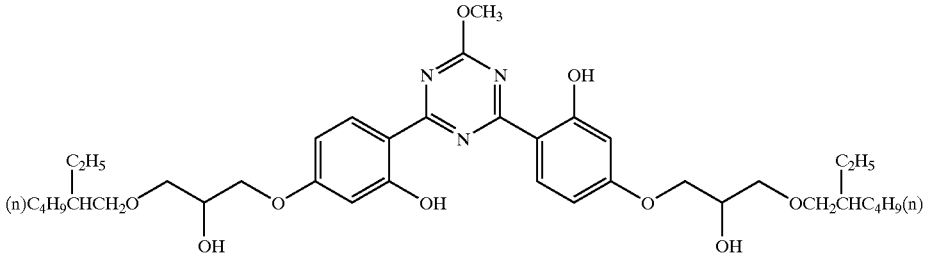
III-9
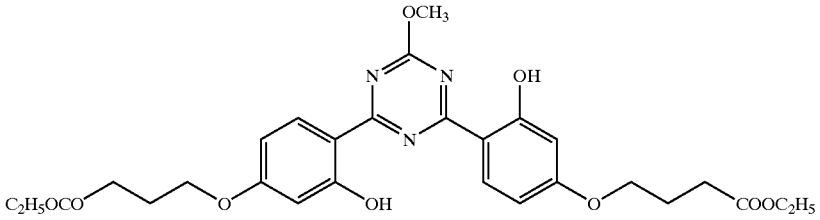
III-10
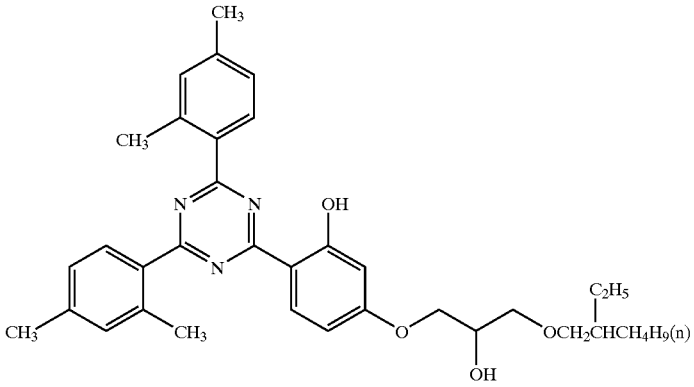
III-11
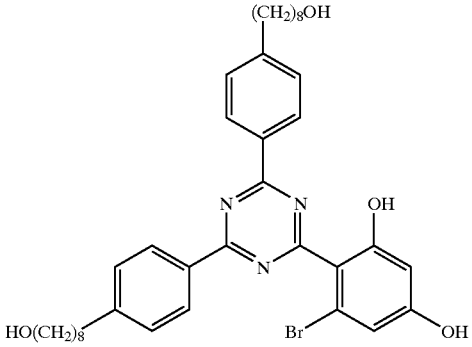
III-12
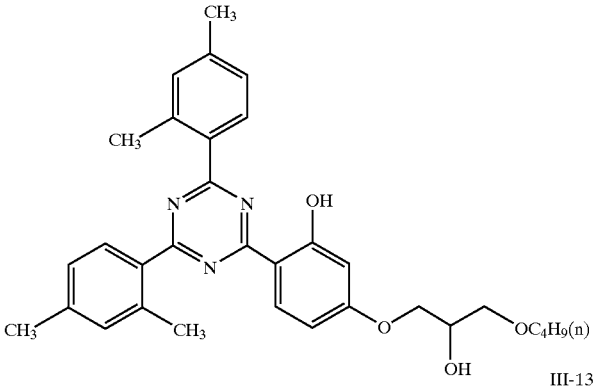
III-13
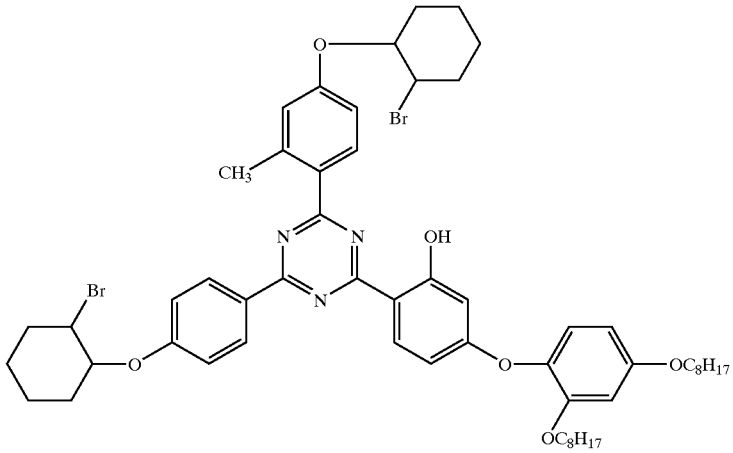

-continued
III-14
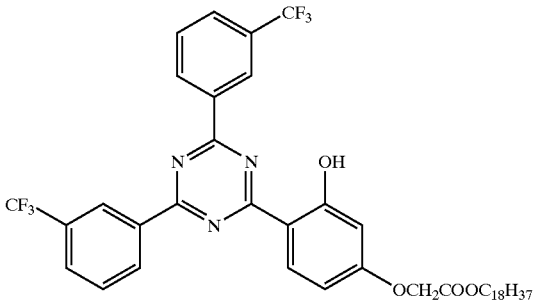
III-15
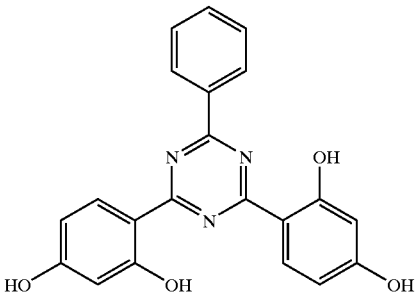
III-16
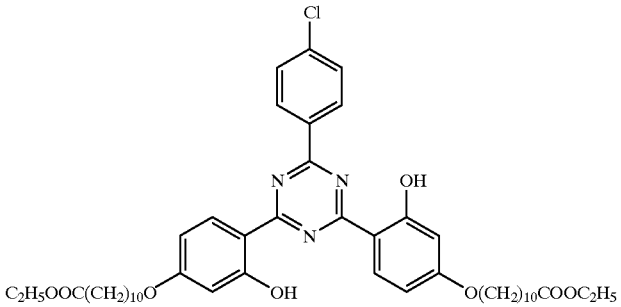
III-17
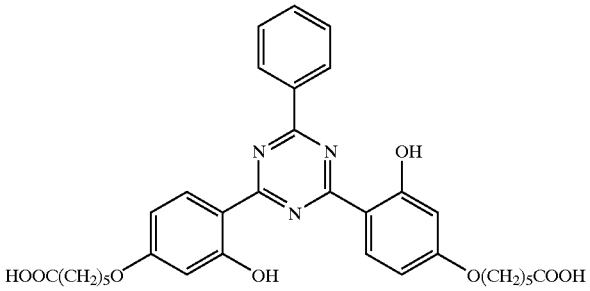
III-18
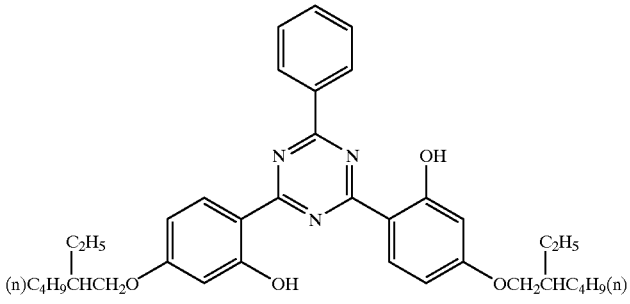
III-19
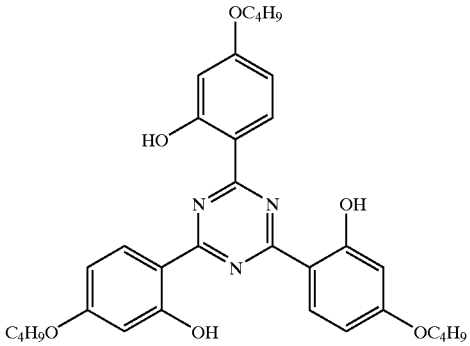

-continued
III-20
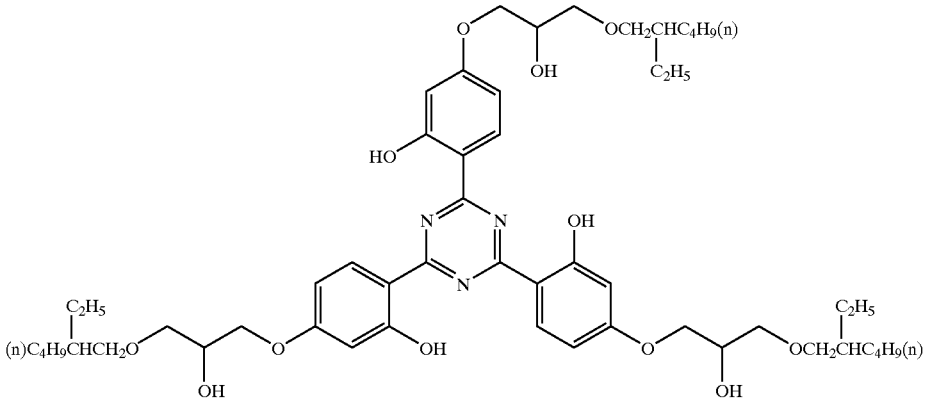
III-21
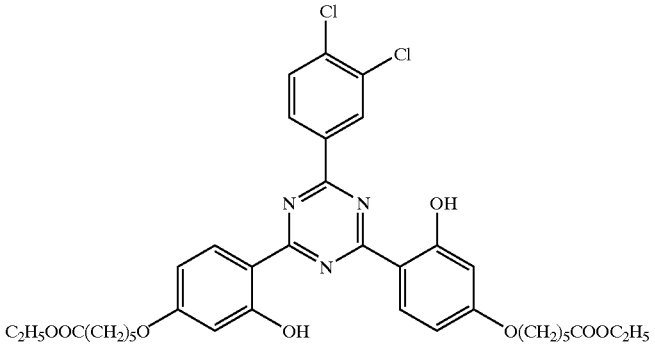
III-22
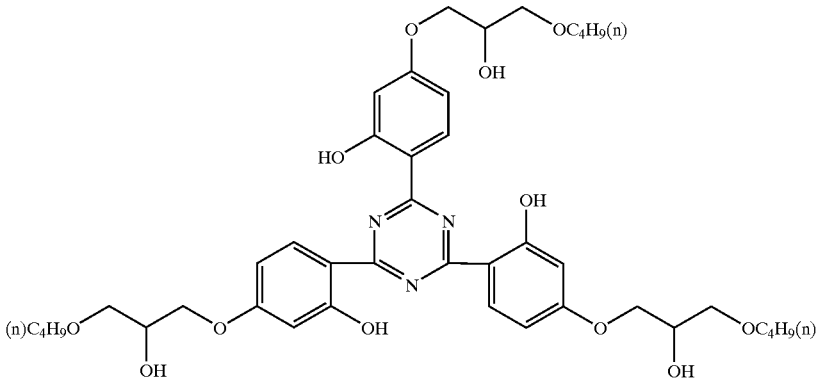
III-23
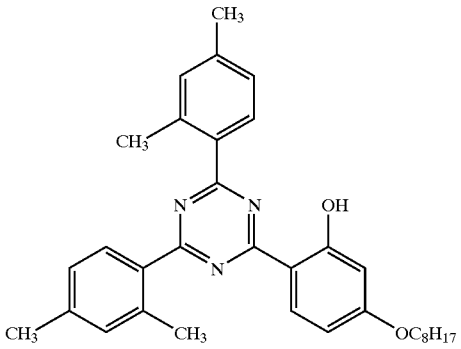

-continued
III-24
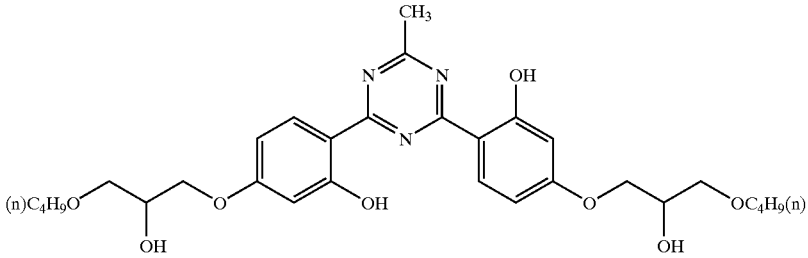
III-25
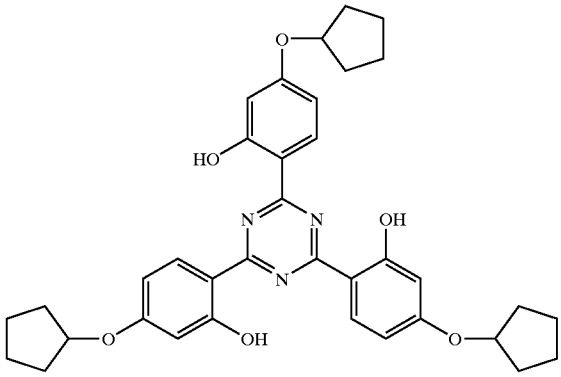
III-26
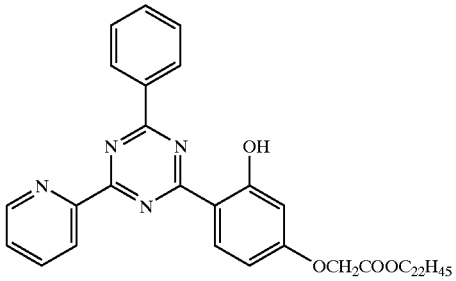
III-27
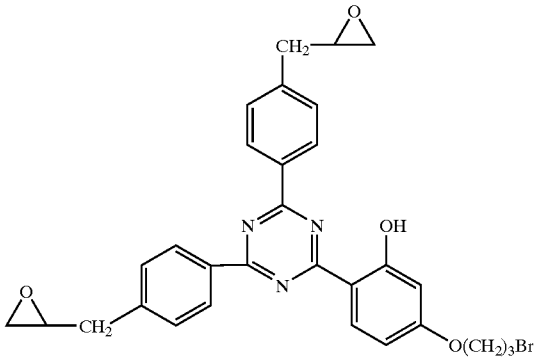
III-28
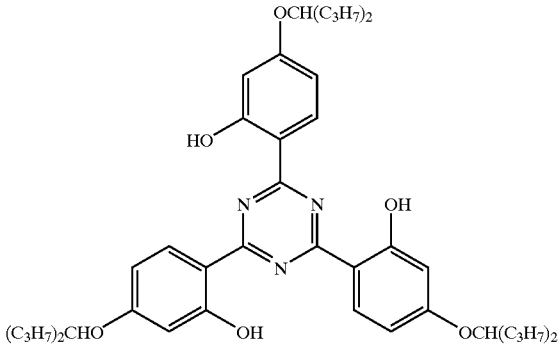

-continued

III-29

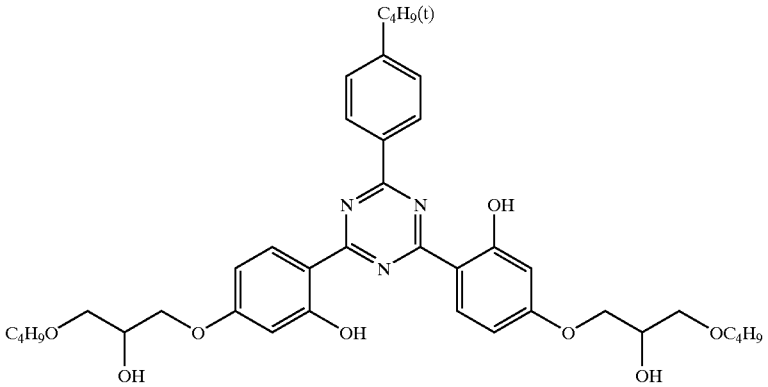

III-30

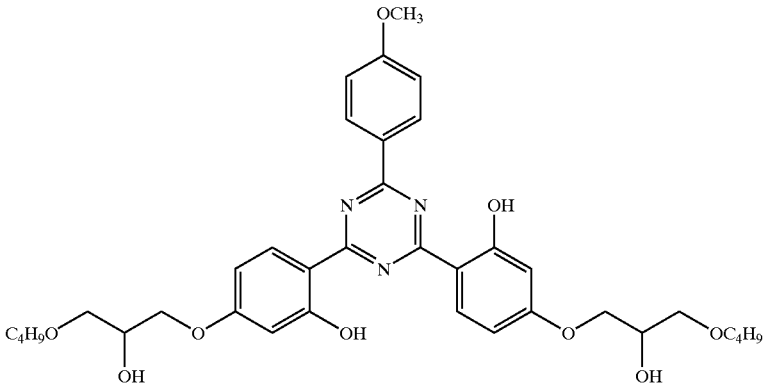

III-31

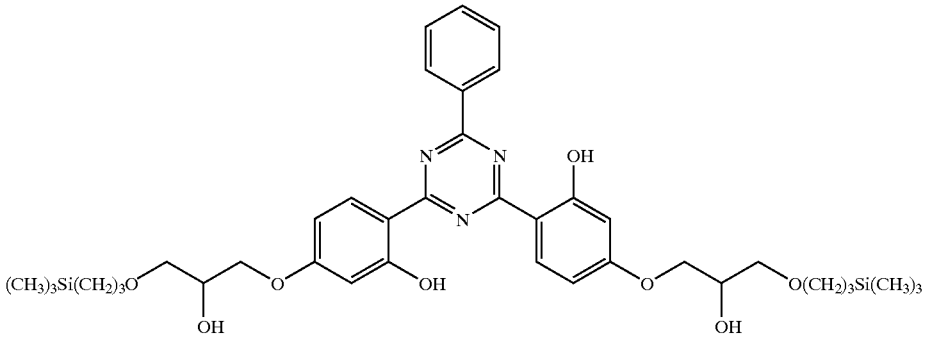

III-32

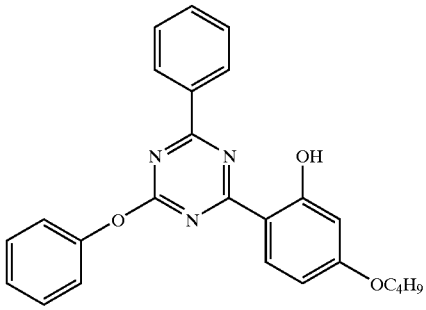

The UV absorbent is preferably contained in the light-insensitive layer, and more preferably in the layer provided on a light-sensitive layer provided farthest from the support. The UV absorbent by formula (I), (II) or (III) may be used alone or in combination with other UV absorbent(s) having a different chemical structure, but at least two, and more preferably at least three selected from the foregoing UV absorbents of formula (I), (II) and (III) are preferably used in combination, at least one of which is still more preferably liquid. In cases where the UV absorbent is contained together with a hydrophilic or hydrophobic binder, the binder is contained preferably in an amount of 5 to 100%, and more preferably 5 to 50% by weight, based on the UV absorbent. The UV absorbent is coated preferably in such an amount that the UV absorbent exhibits an absorbance at 360 nm of at least 0.6, more preferably at least 1.0, and still more preferably at least 1.5. The UV absorbent is dispersed in a binder, preferably together with a high boiling solvent such as waxes.

Decolorizing Agent for UV Absorbent

In a photothermographic material containing a UV absorbent, in cases when at least a part of the UV absorbent remains in the photothermographic material, without being decomposed after subjected to thermal development, the residual UV absorbent often lowers efficiency of printing on a pre-sensitized plate (PD plate) by using UV rays. It is therefore preferred to incorporate the following decolorizing agent effective for decolorizing the UV absorbent in the UV absorbent-containing layer or a layer adjacent thereto.

Examples of the decolorizing agent for the UV absorbent include an adduct of bisphenol and alkylene oxide, methyloamide or bisamide having a melting point of not lower than 110° C., long chain 1,2-glycol, an aduct of terephthalic acid and alkylene oxide, solid alcohols such as stearyl alcohol described in JP-B No. 50-17865, polyethylene glycol and 1,8-octanediol, polyethers or polyethylene glycol derivatives such as polyethylene oxide, sorbitan monostearate and oxyethylene-alkylamine, as described in JP-B 50-17876 and 50-17868, acetoamides described in JP-B No. 51-19991, stearoamides, phthalonitrile, m-nitroaniline and β-naphthylamine, guanidine derivatives described in JP-B No. 51-29024, and amines or quaternary ammonium salts such as hexadecylamine, tribenzylamine, 2-aminobemzoxazole and hexadecyltrimethylammonium chloride. The foregoing decolorizing agents for UV absorbents are contained preferably in an amount of 0.05 to 8 g/m$^2$.

Other Components in Photothermographic Material

A light-insensitive layer may be provided on the outermost side of the light-sensitive layer to protect the light-sensitive layer or prevent abrasion marks from occurring. Binders used in the light-insensitive layer may be the same as or different from those used in the light-sensitive layer.

To accelerate thermal development, the amount of a binder contained in the light-sensitive layer is preferably 1.5 to 10 g/m$^2$, and more preferably 1.7 to 8 g/m$^2$. The content of less than 1.5 g/m$^2$ results in a marked density increase in the unexposed area, leading to levels unacceptable in practical use.

It is preferred to incorporate a matting agent to the image forming layer-side. Thus, it is preferred to allow a matting agent to exist on the surface of the photothermographic material to prevent images formed after thermal processing from abrasion. The amount of the matting agent is preferably 0.5 to 30% by weight, based on the whole binder of the light-sensitive layer-side. In cases where at least a non-image forming layer is provided on the side opposite to the light-sensitive layer, the non-image forming layer preferably contains a matting agent. The matting agent may be either regular form or irregular form, and preferably is a regular form and a spherical form is more preferred.

To control the amount or wavelength distribution of light passing through the light-sensitive layer, a filter dye layer may be provided on the light-sensitive layer side or an antihalation dye layer, a so-called backing layer may be provided on the opposite side. Alternatively, a dye or pigment may be incorporated into the light-sensitive layer.

Lubricants such as polysiloxane compounds, waxes or liquid paraffin may be incorporated in the light-insensitive layer, together with the foregoing binder or matting agent. 0068Various surfactants are used as a coating aid. Specifically, fluorinated surfactants are preferably used to improve antistatic properties or prevent dot-formed coating troubles.

The light-sensitive layer of the photothermographic material may be comprised of plural layers and to control the contrast, the light-sensitive layer may be arranged in the order of high-speed layer/low-speed layer or low-speed layer/high-speed layer.

Examples of suitable image toning agents used in the invention are described in Research Disclosure Item No. 17029 (June, 1978, page 9–15).

There may be incorporated mercapto compounds, disulfide compounds or thione compounds to control the thermal development speed by accelerating or retarding thermal development, to enhance spectral sensitization efficiency or to enhance storage stability before or after thermal development. There may also be used antifoggant, which may be incorporated into any one of the light-sensitive layer, light-insensitive layer or other layers. Furthermore, surfactants, antioxidants, stabilizers, plasticizers or covering aids may be used in photothermographic materials used in the invention. These additives and other additives described above are described in Research Disclosure Item No. 17029.

The support used in the invention is preferably a plastic resin film, such as polyethylene terephthalate, polycarbonate, polyimide, nylon, cellulose triacetate, and polyethylene naphthalate) to obtain an intended density or prevent image deformation after thermal development. of these, plastic resin support of polyethylene terephthalate or styrene type polymer having syndiotactic structure is more preferred. The support thickness is preferably 50 to 300 μm, and more preferably 70 to 180 μm. There may be used a plastic resin support which has been subjected to a thermal treatment. Plastic resins adopted therein are those described above. As a thermal treatment, the support is preferably heated at a temperature higher than the glass transition temperature of the support by at least 30° C., more preferably at least 35° C., and still more preferably at least 40° C. Heating at a temperature exceeding the melting temperature of the support often vitiates uniformity in strength of the support.

Electrically conductive compounds, such as metal oxides and/or conductive polymers may be incorporated into the component layer to improve electrification properties. These compounds may be incorporated in any layer, and a sublayer, backing layer or interlayer between the light-sensitive layer and sublayer is preferred.

Photothermographic materials according to the invention are prepared using an organic solvent. One feature of the invention is that the photothermographic has a residual organic solvent content of 30 to 500 mg/m$^2$.

Examples of organic solvents usable in the invention include ketones such as acetone, isophorone, ethyl amyl ketone, methyl ethyl ketone, methyl isobutyl ketone; alcohols such as methyl alcohol, ethyl alcohol, n-propyl alcohol, isopropyl alcohol, n-butyl alcohol, isobutyl alcohol, diacetone alcohol, cyclohexanol, and benzyl alcohol; glycols such as ethylene glycol, diethylene glycol, triethylene glycol, propylene glycol and hexylene glycol; ether alcohols such as ethylene glycol monomethyl ether, and diethylene glycol monomethyl ether; ethers such as ethyl ether, dioxane, and isopropyl ether; esters such as ethyl acetate, butyl acetate, amyl acetate, and isopropyl acetate; hydrocarbons such as n-pentane, n-hexane, n-heptane, cyclohexene, benzene, toluene, xylene; chlorinated compounds such as chloromethyl, chloromethylene, chloroform, and dichlorobenzene; amines such as monomethylamine, dimethylamine, triethanol amine, ethylenediamine, and triethylamine; and water, formaldehyde, dimethylformaldehyde, nitromethane, pyridine, toluidine, tetrahydrofuran and acetic acid. The solvents are not to be construed as limited to these examples. These solvents may be used alone or in combination. The solvent content in the photosensitive material can be adjusted by varying conditions such as temperature conditions in the drying stage after the coating stage. The solvent content can be determined by means of gas chromatography under conditions suitable for detecting the solvent and measured in the following manner. Thus, a photothermographic material is cut to a given size, which is to be accurately measured. This sample is finely chopped and sealed in a specified vial. After setting the vial onto a head space sampler, HP7694 (available from Hewlett-Packard Corp.) and heated to a prescribed temperature, the sample is introduced into gas chromatography. The solvent content can be determined by measuring the peak area of the intended solvent. All of the contained solvents cannot be determined by only one injection, so that measurement is made through the multi-space method by repeated injection of an identical sample. The residual organic solvent content is the total amount of the organic solvent remained in component layers including the light-sensitive layer side and backing layer side. The total residual organic solvent content of a photothermographic material used in the invention is 30 to 500 mg/m$^2$, and preferably 100 to 300 mg/m$^2$. The solvent content within the range described above leads to a thermally developable photosensitive material with low fog density as well as high sensitivity.

Image Formation Method

One feature of the image formation method of the invention concerns exposure of the photothermographic material using a light source having an emission region of relatively short wavelengths of 350 to 450 nm (preferably 370 to 420 nm), in place of near-infrared light of 600 to 800 nm, to form half tone dot images, thereby displaying effects of the invention (such as dot image density, linearity, contrast-increasing and prevention of residual dye staining). In addition thereto, incorporation of a decolorizing agent into the light-insensitive layer to absorb UV absorbent rays is preferred, thereby removing any remaining color due to the UV absorbent remaining in the thermally developed photothermographic material and leading to enhanced efficiency in the next step of printing onto a PS plate by Y UV rays.

In the image formation method of the invention, the photothermographic material is exposed to light to form half tone dot images using a short wave incoherent light source having an emission maximum at a wavelength of 350 to 450 nm (preferably 370 to 420 nm), thereby enhancing effects of the invention (i.e., achieving superiority in characteristics such as dot image density, linearity, contrast-increasing, residual dye stains). The reason thereof is not definitely clarified but it is supposed as follows. It is known that in conventional wet-process type photographic materials, the use of coherent light results in superior dot images compared to the use of incoherent light. However, it was confirmed by the experimental results according to the inventor of the present invention that in photothermographic materials relating to the invention, dot images with relatively high contrast and enhanced density were achieved by the use of incoherent light rather than the use of coherent light The reason for the difference in exposure between conventional wet-process type photographic materials and dry-process type photothermographic materials has not necessarily been clarified but it is contemplated to be attributed to the fact that the photothermographic material, silver halide grains are of a relatively small grain size, the light-sensitive layer being relatively thick and the organic silver salt existing in the form of needle-like crystals. Thus, it is supposed that such characteristics of the photothermographic material cause coherent light to be scattered, leading to deteriorated dot image quality.

The expression "incoherent" means the light phases being not the same, indicating that it is not a laser light but refers to an exposure light source for use in conventional silver salt photographic materials, so-called room light handling materials. Examples thereof include LED (Light Emission Diode), electrodeless lamp AEL (product by DAINIPPON SCREEN MFG. CO., LTD., daylight printer 647, emission wavelength of 360 to 440 nm), mercury lamp CHM-1000 (product by DAINIPPON SCREEN MFG. CO., LTD., daylight printer 607, emission wavelength of 360 to 440 nm), mercury lamp HL30201BF and UV lamp for use in exposure of PS plates.

To form dot images using an incoherent light source, the photothermographic material is subjected to dot-exposure to light which has been transmitted through a glass fiber from a light source.

Th e image formation method using incoherent light according to the invention leads to dot images with relatively high density and high contrast. In the future, it will be employed in a high-speed exposure apparatus, in which image signals are introduced into a liquid crystal panel provided on a light-transmittable support to form images and using the thus formed images as a master, t he photothermographic material is subjected to a single exposure (or exposure of one time) through a light source such as a UV lamp to form dot images.

EXAMPLES

Example 1

Preparation of Subbed PET Support

Both surfaces of a biaxially stretched thermally fixed 125 μm polyethylene terephthalate (hereinafter, also denoted simply as PET) film, available from Teijin Co., Ltd., were subjected to a plasma treatment 1 under the c ondition described below. onto the surface of one side, the subbing coating composition a-1 described below was applied so as to form a dried layer thickness of 0.8 μm, which was then dried. The resulting coating was designated Subbing Layer A-1. Onto the opposite surface, the subbing coating composition b-1 described below was applied to form a dried layer thickness of 0.8 μm. The resulting coating was designated as Subbing Layer B-1. Both sublayer surfaces were each subjected to plasma treatment 2 under the condition described below.

Plasma Treatment Condition

Using a batch type atmospheric plasma treatment apparatus (AP-1-H-340, available from E.C. Chemical Co., Ltd.), plasma treatment 1 and plasma treatment 2 were each conducted at a high frequency output of 4.5 kW and a frequency of 5 kHz over a period of 5 sec. in an atmosphere of argon, nitrogen and hydrogen in a ratio of 90%, 5% and 5% by volume, respectively.

| Subbing Coating Composition a-1 | |
|---|---|
| Latex solution (solid 30%) of a copolymer consisting of butyl acrylate (30 weight %) , t-butyl acrylate (20 weight %) styrene (25 weight %) and 2-hydroxy ethyl acrylate (25 weight %) | 270 g |
| Hexamethylene-1,6-bis(ethyleneurea) | 0.8 g |
| Polystyrene fine particles (av. size, 3 μm) | 0.05 g |

-continued

| | |
|---|---|
| Colloidal silica (av. particle size, 90 μm) | 0.1 g |
| Water to make | 1 liter |
| Subbing Coating Composition b-1 | |
| Tin oxide doped with 0.1% by weight indium having an average particle size of 36 nm | 0.26 g/m$^2$ |
| Latex liquid (solid portion of 30%) of a copolymer consisting of butyl acrylate (30 weight %) styrene (20 weight %) glycidyl acrylate (40 weight %) | 270 g |
| Hexamethylene-1,6-bis(ethyleneurea) | 0.8 g |
| Water to make | 1 liter |

Thermal Treatment of Support

The thus subbed support was heated at a temperature of 140° C. in the sublayer-drying process and gradually cooled, while being transported at a tension of $1\times10^5$ Pa.

Back Layer-side Coating

Back layer coating solution 3 and backing protective layer coating solution 4 were each filtered using a filter of a semi-complete filtration precision of 20 μm, then, simultaneously coated on the antistatic sublayer B-1 of the support at a coating speed of 120 m/min so as to form a total wet thickness of 30 μm, and dried at 60° C. for 4 min.

| Back Layer Coating Solution 3 | |
|---|---|
| Methyl ethyl ketone | 16.4 g/m$^2$ |
| Polyester resin (Vitel PE2200B, available from Bostic Co.) | 106 mg/m$^2$ |
| Cellulose Acetate-propionate (CAP504-0.2, available from Eastman Chemical Co.) | 1.0 g/m$^2$ |
| Cellulose acetate-butylate (CAB381-20, available from Eastman Chemical Co.) | 1.0 g/m$^2$ |
| Backing Protective Layer Coating Solution 4 | |
| Methyl ethyl ketone | 22 g/m$^2$ |
| Polyester resin (Vitel PE2200B, available from Bostic Co.) | 106 mg/m$^2$ |
| Antistatic agent $(CH_3)_3SiO—[(CH_3)_2Si]_{20}—[CH_3Si\{CH_2CH_2CH_2O(CH_2CH_2O)_{10}—(CH_2CH_2CH_2O)_{15}CH_3\}]_{30}—Si(CH_3)_3$ | 22 mg/m$^2$ |
| $C_8F_{17}SO_3Li$ | 10 mg/m$^2$ |
| Cellulose Acetate-propionate (CAP504-0.2, available from Eastman Chemical Co.) | 1.0 g/m$^2$ |
| Cellulose acetate-butylate (CAB381-20, available from Eastman Chemical Co.) | 1.0 g/m$^2$ |
| Matting agent (SILOID74, av. particle size of 7 μm, available from Fuji-Davison Co.) | 17 mg/m$^2$ |

Preparation of Light-Sensitive Layer

Preparation of Light-sensitive Silver Handle Emulsion B

| Solution A1 | |
|---|---|
| Phenylcarbamoyl gelatin | 88.3 g |
| Compound (A) (10% methanol solution) | 10 ml |
| Potassium bromide | 0.32 g |
| Water to make | 5429 ml |
| Solution B1 | |
| 0.67 mol/l Aqueous silver nitrate solution | 2635 ml |
| Solution C1 | |
| Potassium bromide | 51.55 g |
| Potassium iodide | 1.47 g |
| Water to make | 660 ml |

-continued

| Solution D1 | |
|---|---|
| Potassium bromide | 154.9 g |
| Potassium iodide | 4.41 g |
| Iridium chloride (1% solution) | 0.93 ml |
| Solution E1 | |
| 0.4 mol/l aqueous potassium bromide solution Amount necessary to adjust silver potential | |
| Solution F1 | |
| Aqueous 56% acetic acid solution | 16.0 ml |
| Solution G1 | |
| Anhydrous sodium carbonate | 1.72 g |
| Water to make | 151 ml |
| Compound (A) | |

$HO(CH_2CH_2O)_n—(CH(CH_3)CH_2O)_{17}—(CH_2CH_2O)_mH$ (m+n=5 to 7)

Using a stirring mixer described in JP-B 58-58288 and 58-58289, ¼ of solution B1, the total amount of solution C1 were added to solution A1 by the double jet addition for 4 min 45 sec. to form nucleus grain, while maintaining a temperature of 45° C. and a pAg of 8.09. After 7 min, ¾ of solution B1 and the total amount of solution D1 were further added by the double jet addition for 14 min 15 sec., while mainlining a temperature of 45° C. and a pAg of 8.09. After stirring for 5 min., the reaction mixture was lowered to 40° C. and solution F1 was added thereto to coagulate the resulting silver halide emulsion. Remaining 2000 ml of precipitates, the supernatant was removed and after adding 10 lit. water with stirring, the silver halide emulsion was again coagulated. Remaining 1500 ml of precipitates, the supernatant was removed and after adding 10 lit. water with stirring, the silver halide emulsion was again coagulated. Remaining 1500 ml of precipitates, the supernatant was removed and solution H1 was added. The temperature was raised to 60° C. and stirring continued for 120 min. Finally, the pH was adjusted to 5.8 and water was added there to so that the weight per mol of silver was 1161 g, and light-sensitive silver halide emulsion B was thus obtained. It was proved that the resulting emulsion was comprised of monodisperse silver iodobromide cubic grains having an average grain size of 0.058 μm, a coefficient of variation of grain size of 12% and a [100] face ratio of 92%.

Preparation of Powdery Organic Silver Salt B

Behenic acid of 130.8 g, arachidic acid of 67.7 g, stearic acid of 43.6 g and palmitic acid of 2.3 g were dissolved in 4720 ml of water at 90° C. Then, 540.2 ml of aqueous 1.4 mol/l NaOH was added, and after further adding 6.9 ml of concentrated nitric acid, the mixture was cooled to 55° C. to obtain a fatty acid sodium salt solution. To the thus obtained fatty acid sodium salt solution, 45.3 g of light-sensitive silver halide emulsion B-3 obtained above and 450 ml of water were added and stirred for 5 min., while being maintained at 55° C. Subsequently, 760 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 μS/cm. Using a flush jet dryer (produced by Seishin Kigyo Co., Ltd.), the thus obtained cake-like organic silver salt was dried according to the operation condition of a hot air temperature of 75° C. at the inlet of the dryer until reached a moisture content of 0.1%. The moisture content of the thus obtained powdery organic silver salt B was measured by an infrared ray aquameter.

Preparation of Pre-dispersion B

In 1457 g MEK was dissolved 14.57 g of polyvinyl butyral powder (B-79, available from Monsanto Co.) and further thereto was gradually added 500 g of powdery organic silver salt B to obtain pre-dispersion B1 while stirring by a dissolver type homogenizer (DISPERMAT Type CA-40, available from VMA-GETZMANN).

Preparation of Light-sensitive Dispersion B

Thereafter, using a pump, the thus prepared pre-dispersion was transferred to a media type dispersion machine (DISPERMAT Type SL-C12 EX, available from VMA-GETZMANN), which was packed 1 mm Zirconia beads (TORESELAM, available from Toray Co. Ltd.) by 80%, and dispersed at a circumferential speed of 8 m/s and for 1.5 min. of a retention time width a mill to obtain light-sensitive emulsion B.

Preparation of Solution (d)

In 10.1 g of methanol were dissolved 0.1 g of the following compound P and 0.1 g of compound Q to prepare solution (d).

Preparation of Sensitizing Dye Solution (a)

Sensitizing dye 1 of 29 mg, 4.5 g of 2-chlorobenzoic acid, 8.4 g of solution (d) and 280 mg of 5-methyl-2-mercaptobenzimidazole were dissolved in 77.2 ml MEK at a dark room to prepare sensitizing dye solution (a) for use in Sample 1.

Preparation of Sensitizing Dye Solution (b)

Sensitizing dye 2 of 29 mg, 4.5 g of 2-chlorobenzoic acid, 8.4 g of solution (d) and 280 mg of 5-methyl-2-mercaptobenzimidazole were dissolved in 77.2 ml MEK at a dark room to prepare sensitizing dye solution (b) for use in Sample 2.

Preparation of Sensitizing Dye Solution (c)

Sensitizing dye 3 of 29 mg, 4.5 g of 2-chlorobenzoic acid, 8.4 g of solution (d) and 280 mg of 5-methyl-2-mercaptobenzimidazole were dissolved in 77.2 ml MEK at a dark room to prepare sensitizing dye solution (c) for use in Sample 3.

Preparation of Additive Solution (a)

A reducing agent (exemplified compound A-4) of 107 g and 4.8 g of 4-methylphthalic acid were dissolved in 261 g of MEK to prepare additive solution (a)

Preparation of Additive Solution (b)

Antifoggant 2 of 21.7 g was dissolved in 137 g of MEK to prepare additive solution (b).

Preparation of Additive Solution (c)

An alkoxysilane compound, $C_6H_5$—NH—$(CH_2)$—Si—$(OCH_3)_3$ of 21.7 g and 45 g of antifoggant 3 were dissolved in 159 g of MEK to prepare additive solution (c).

Preparation of Light-sensitive Layer Coating Solution (a)

The foregoing light-sensitive dispersion B of 1641 g and 506 g of MEK were maintained at a temperature of 21° C. and 10.75 g of antifoggant 1 (11.2% methanol solution) was added thereto and stirred for 1 hr. Further thereto was added 13.6 g of calcium bromide (11.2% methanol solution) and stirred for 20 min. Subsequently, 1.3 g of solution (d) was added thereto and stirred for 10 min., then, sensitizing dye solution (a) was added and stirred for 1 hr. Thereafter, the temperature was lowered to 13° C. and stirring was continued for 30 min. Polyvinyl butyral, Butvar B-79 (available from Monsanto Co.) of 349.6 g was added and stirred for 30 min., while maintained at 13° C., followed by adding 95 mg of 5-methyl-2-mercaptobenzimidazole and 3.5 g of tetrachlorophthalic acid and stirring for a period of 30 min. Thereafter were added 12 g of 5-nitroindazole, 0.4 g of 5-nitroimidazole, 1.2 g of contrast-increasing agent V-1 (vinyl compound), 19 g of contrast-increasing agent H-2 (hydrazine compound) and 225 g of MEK. Subsequently, 148.6 g of additive solution (a), 148.6 g of additive solution (b) and 225 g of additive solution (c) were successively added with stirring to obtain light-sensitive layer coating solution (a) for use in Sample No. 1.

Light-sensitive Layer Coating Solution (b)

Light-sensitive layer coating solution (b) for use in Sample No. 2 was prepared similarly to coating solution (a), except that sensitizing dye solution (a) was replaced by an equivalent amount of sensitizing dye solution (b).

Light-sensitive Layer Coating Solution (c)

Light-sensitive layer coating solution (c) for use in Sample No. 3 was prepared similarly to coating solution (a), except that sensitizing dye solution (a) was replaced by an equivalent amount of sensitizing dye solution (c).

Light-sensitive Layer Coating Solution (d)

Light-sensitive layer coating solution (d) for use in Sample No. 4 was prepared similarly to coating solution (a), except that sensitizing dye solution (a) was replaced by an equivalent amount of sensitizing dye solution (d).

Preparation of Matting Agent Dispersion

Monodisperse silica particles having an average size of 3.5 $\mu$m was added to MEK, in a rati of 50 mg of silica to 1.7 g/m$^2$ of MEK and dispersed using a dissolver type homogenizer at 8000 rpm for 30 min. to obtain a dispersion of a matting agent.

Preparation of Additive Solution (d)

Phthalazinone was dissolved in MEK in a ratio of 0.17 g/m$^2$ of phthalazinone to 2.73 g/m$^2$ of MEK to obtain additive solution (d).

Preparation of Protective Layer Coating Solution

In 15.9 g of MEK were dissolved with stirring 1.8 g of cellulose acetate-butyrate (CAB171-15, available from Eastman Chemical Co.), 85 mg of polymethyl methacrylate (PARALOID A-21, available from Rohm & Haas Co.), 20 mg of benzotriazole, 13 mg of fluorinated surfactant F-1 ($C_8F_{17}SO_3Li$) and 50 mg of fluorinated surfactant F-2 [$C_8F_{17}(CH_2CH_2O)_{22}C_8F_{17}$]. Further thereto, 1.75 g of matting agent dispersion was added with stirring to prepare a coating solution of a protective layer, provided that the weight corresponds to the coating amount per m$^2$.

Compound P

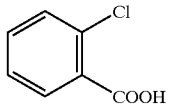

Compound Q

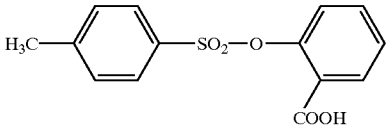

-continued

Sensitizing dye 1

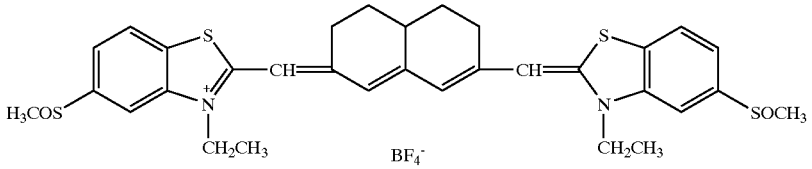

Sensitizing dye 2

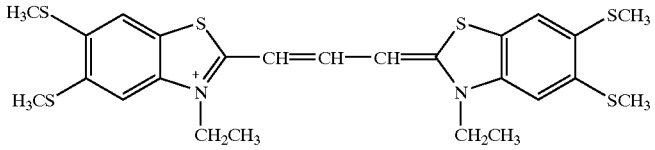

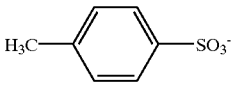

Sensitizing dye 3

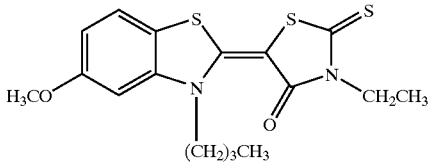

Antifoggant 2

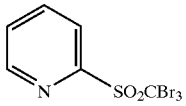

Antifoggant 3

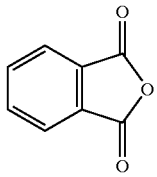

Antifoggant 1

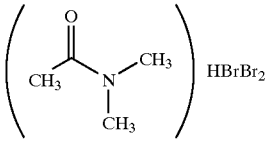

Contrast-increasing agent 1

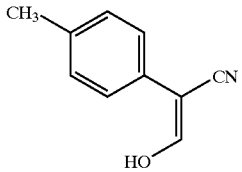

Contrast-increasing agent 2

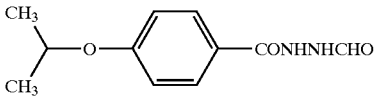

Preparation of Photothermographic Material Sample

Preparation of Sample No. 1

Light-sensitive Layer Side Coating

Viscosities of the foregoing light-sensitive layer coating solution (a) and surface protective layer coating solution were each adjusted to 0.228 and 0.184 Pa·s, respectively, by adjusting the solvent amount. After filtering by allowing to pass through a filter having a semi-absolute filtration precision of 20 $\mu$m, the coating solutions were ejected from slits of an extrusion type die coater and simultaneously coated on sublayer A-1 of the support at a coating speed of 90 m/min. After 8 sec., the thus coated sample was dried using hot air of a dry bulb temperature of 75° C. and a dew point of 10° C. over a period of 5 min. and wound up on a roll at a tension of 196 N/m (or 20 kg/m) in an atmosphere of 23° C. and 50% RH to obtain photothermographic material sample No. 1. having a silver coating amount of 1.5 g/m$^2$ and a dry thickness of 2.5 $\mu$m.

Preparation of Sample Nos. 2 through 4

Similarly to sample No. 1, photothermographic material samples Nos. 2, 3 and 4 were each prepared, except that light-sensitive layer coating solution (a) was replaced by light-sensitive layer coating solutions (b), (c) and (d), respectively.

Preparation of Sample No. 5

Preparation of Silver halide Emulsion A

In 700 ml of water were dissolved 11 g of phthalated gelatin, 30 mg of potassium bromide and 10 mg of sodium benzenethiosulfonate. After adjusting the temperature and the pH to 55° C. and 5.0, respectively, 159 ml of an aqueous solution containing 18.6 g silver nitrate and 159 ml of an aqueous equimolar potassium bromide solution were simultaneously added by the controlled double jet addition in 3 min. 30 sec. Then, 446 ml of an aqueous solution containing 55.5 g of silver nitrate and an aqueous solution containing 1 mol/l of potassium bromide were added by the double jet addition in 15 min. 30 sec., while maintaining the pAg at 7.7. Then the emulsion was subjected to coagulation washing to remove soluble salts by lowering the pH. Thereafter, 0.17 g of the following compound A and 23.7 g of deionized gelatin having a calcium content of less than 20 ppm were added thereto, and the pH and pAg were adjusted to 5.9 and 8.0, respectively. There were obtained non-monodisperse, cubic silver halide grains having an average grain size of 0.058 $\mu$m (equivalent circular diameter), a variation coefficient of grain size of 8%, and the proportion of the {100} face of 93%.

The thus obtained silver halide grain emulsion was heated to 60° C. and sodium benzenethiosulfonate of 76 μmol per mol of silver was added, after 3 min., sodium thiosulfate 154 μmol per mol of silver was added, and the emulsion was ripened for 100 min. Thereafter, the temperature was maintained at 40° C., then, $6.4\times10^{-4}$ mol/mol Ag of sensitizing dye A and $6.4\times10^{-3}$ mol/mol Ag were added and after stirring for 20 min., the emulsion was cooled to 30° C. to obtain silver halide grain emulsion A.

Compound A

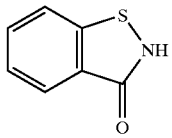

Sensitizing Dye A

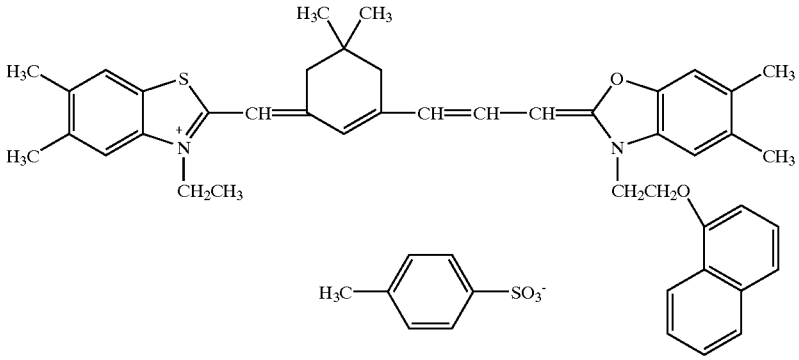

Compound B

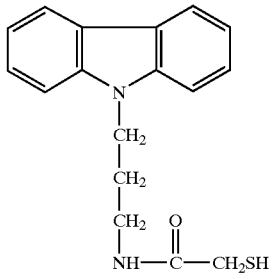

Preparation of Organic Silver Salt Dispersion A

Arachdic acid of 6.1 g behenic acid of 37.6 g, 700 ml distilled water and 123 ml of 1 mol/l NaoH aqueous solution were mixed, stirred at 75° C. for 60 min. and the temperature was lowered to 65° C. Subsequently, 112.5 ml of an aqueous solution containing 22 g of silver nitrate solution was added thereto for 45 sec., allowed to stand for 20 min and cooled to 30° C. The solid product was filtered using a suction funnel and then subjected to water washing until the conductivity of the filtrate reached 30 μS/cm. The thus obtained solid was treated in a wet cake form, without being dried. To the wet cake equivalent to 100 g of dried solid, 5 g of polyvinyl alcohol (PVA-205, available from KURARAY Co., Ltd.) and water were added to make the total amount of 500 g with stirring by a homomixer. The thus obtained preliminary dispersion was treated three times in a dispersing machine (Microfluidizer M-110S-EH, available from Microfluidex International Corp., in which interaction chamber G10Z was employed), adjusted to a pressure of 1750 kg/cm$^2$, to obtain organic silver salt dispersion A. The thus obtained organic silver salt dispersion A was comprised of needle-form organic silver salt grains having an average minor axis length of 0.04 μm, an average major axis length of 0.08 μm and a variation coefficient of 30%. The grain size was measured using Master Sizer X, available from Malvern Instrument Ltd. Cooling was conducted by providing coiled condensers in the front and rear of interaction chamber and the intended temperature was set by adjusting the refrigerant temperature.

Preparation of Solid Particle Dispersion of Reducing Agent

To 20 g of 1,1-bis(2-hydroxy-3,5-dimethylphenyl)-3,5,5-trimethylhexane were added 3.0 g of MP polymer (MP 203, available from KURARAY Co., Ltd.) and 77 ml of water with stirring and allowed to stand for 3 hrs. as slurry. The slurry was added into a vessel together with 360 g of zirconia beads having an average diameter of 0.5 mm and dispersed for 3 hrs. by a dispersing machine (1/4 G Sand Grinder Mill, available from IMEX Co. Ltd.) to obtain a solid particle dispersion of the reducing agent, 80% by weight of which was accounted for by particles having sizes of 0.3 to 1.0 μm.

Preparation of Dispersion of Tribromomethylphenylsulfone

Hydroxypropylmethyl cellulose of 0.5 g, 0.5 g of compound C and 88.5 g of water were added to 30 g of tribromomethylphenylsulfone with stirring and allowed to stand for 3 hrs. as slurry. Thereafter, similarly to the foregoing reducing agent dispersion was prepared a solid particle dispersion of tribromomethylphenylsulfone as an antifoggant, 80% by weight of which was accounted for by particles having sizes of 0.3 to 1.0 μm.

Preparation of Water-based Emulsion Layer Coating Solution A

Binder material shown below and silver halide emulsion A were added to the foregoing organic silver salt dispersion A in amounts per mol of the silver of organic silver salt dispersion A. After adding water, the pH was adjusted to 7.5 with 0.5 M aqueous sulfuric acid solution or 1M aqueous sodium hydroxide solution to obtain water-based emulsion layer coating solution A. The pH adjustment was done using a pH meter, HM-60S, available from TOADENPAKOGYO Co., Ltd. The viscosity of the thus obtained water-based emulsion layer coating solution A was $55\times10^{-3}$ Pa·s.

| | |
|---|---|
| Binder, Laxstar 3307B (SBR latex having a glass transition point of 17° C., available from DAINIPPON INK & CHEMICALD Inc.) | solids 470 g |
| 1,1-Bis(2-hydroxy-3,5-dimethylphenyl)-3,5,5-trimethylhexane | solids 110 g |
| Sodium dihydrogenorthophosphate | 0.44 g |
| Benzotriazole | 1.25 g |
| Tribromomethyphenylsulfone | solids 25 g |
| Polyvinyl alcohol (MP-25, available from KURARAY CO., Ltd.) | 46 g |
| iso-Propylphthalazine | 0.12 mol |
| Compound Z | 0.003 mol |
| Contrast-increasing agent H1 (Exemplified compound C-62) | 0.03 mol |
| Silver halide emulsion A | 0.05 mol Ag |

Compound C

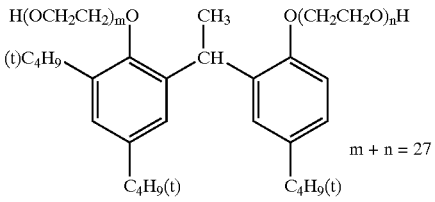

Compound Z

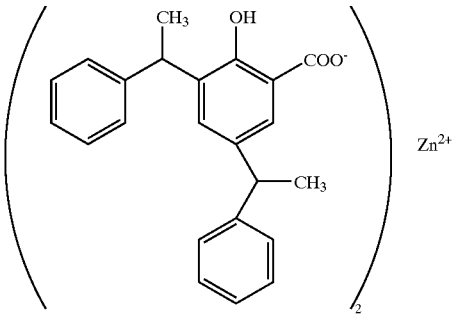

Preparation of Protective Layer Coating Solution

To a binder and materials shown below, water was added and the pH was adjusted to 2.8 to make 150 g of a coating solution of a protective layer of the emulsion layer side. The pH adjustment was made similarly to the foregoing water-based emulsion layer coating solution. The viscosity of the protective layer coating solution was $40\times10^{-3}$ Pa·s.

| | |
|---|---|
| Polymer latex (methyl methacrylate/styrene/2-ethylhexyl acrylate/acrylic acid = 59/9/26/5/1, 27% solid, glass transition point of 55° C.) | 109 g |
| $H_2O$ | 3.75 g |
| Benzyl alcohol as film-making agent | 4.5 g |
| Compound E | 0.45 g |
| Compound F | 0.125 g |
| Compound G | 0.0125 g |
| Polyviny; alcohol (PVA-235, available from KURARAY Co., Ltd.) | 0.225 g |

-continued

| | |
|---|---|
| Water to make | 150 g |

Compound E

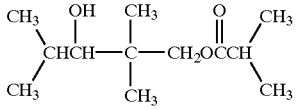

Compound F

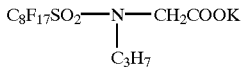

Compound G

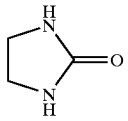

Preparation of Support

There was prepared a support of 125 μm PET film, produced by TEIJIN LTD. having a sublayer on the emulsion layer side and a electrically conductive layer on the back layer side, having the following composition:

| | |
|---|---|
| Emulsion layer side | |
| Sublayer (a) | |
| Polymer latex (methyl methacrylate/styrene/hydroethyl methacrylate/divinylbenzene = 67/30/2.5/0.5 (wt%) | 160 mg/m$^2$ |
| 2,4-Dichloro-6-hydroxy-s-triazine | 4 mg/m$^2$ |
| Matting agent (polystyrene, av. particle size of 2.4) | 3 mg/m$^2$ |
| Sublayer (b) | |
| Alkali-treated gelatin ($Ca^{2+}$ content of 30 ppm, jelly strength of 230 g | 50 mg/m$^2$ |
| Back layer side | |
| Conductive layer | |
| JULYMER ET-410 (NIPPON JUNYAKU Co., ltd.) | 96 mg/m$^2$ |
| Alkali-processed gelatin (MW 10000, ($Ca^{2+}$ content of 30 ppm) | 42 mg/m$^2$ |
| Deionized gelatin ($Ca^{2+}$ content of 0.6 ppm) | 8 mg/m$^2$ |
| Compound A | 0.2 mg/m$^2$ |
| Poly(oxyethylene phenyl ether) | 10 mg/m$^2$ |
| SUMITEX RESIN M-3 (water-soluble melamine compound, available from SUMITOMO CHEMICAL CO. LTD.) | 18 mg/m$^2$ |
| $SnO_2$/Sb (9/1 by weight, needle-form fine particles, major axis/minor axis = 20 to 30, available from ISHIHARA SANGYO KAISHA LTD.) | 160 mg/m$^2$ |
| Matting agent (polymethyl methacrylate, av. particle size of 5 μm) | 7 mg/m$^2$ |
| Protective layer | |
| Polymer latex (copolymer of methyl methacrylate/styrene/2-ethylhextl acrylate/2-hydroxyethyl methacrylate/methacrylic acid = 59/9/26/5/1 by wt %) | 1 g/m$^2$ |
| Polystyrenesulfonate (MW 1000 to 5000) | 2.6 g/m$^2$ |
| Sezole 524 (CHUKYO YUSHI Ltd., Co.) | 25 mg/m$^2$ |
| SUMITEX RESIN M-3 (water-soluble melamine compound, available from SUMITOMO CHEMICAL cO. LTD.) | 218 mg/m$^2$ |

Sublayer of Emulsion Layer Side

Sublayer (a) and sublayer (b) were successively coated on the emulsion layer side of the support and dried at 180° C. for 4 min. On the other side of the support, the foregoing conductive layer and protective layer were successively coated and dried at 180° C. for 30 sec. to make a PET support with a back layer/sublayer. The thus prepared PET support was allowed to pass through a thermal treatment zone maintained at 160° C. and having a total length of 230 m, at a tension of 14 kg/cm$^2$ and a transport speed of 20 m/min. Then after passing through a zone of 40° C. for 15 sec., the sample was wound up at a wind-up tension of 10 kg/cm$^2$.

After being debubbled, the foregoing water-based emulsion layer coating solution was coated on the sublayer (a) and (b) side of the PET support obtained above so as to have a silver coating amount of 1.5 g/m$^2$. Further thereon, the foregoing coating solution of the protective layer for the emulsion layer was coated so as to have a polymer latex solid content of 3.0 g/m$^2$ to obtain sample No. 5.

Preparation of Sample No. 6

Similarly to sample No. 5 was prepared sample No. 6, except that sensitizing dye A was replaced by sensitizing dye 2 contained in sensitizing dye solution (b).

Preparation of Sample No. 7

Similarly to sample No. 5 was prepared sample No. 7, except that sensitizing dye A was replaced by sensitizing dye 3 contained in sensitizing dye solution (c).

Preparation of Sample No. 4-2

Similarly to sample No. 4 was prepared sample No. 4-2, except that the contrast-increasing agent was not incorporated.

Thus obtained samples No. 1 through 8 and No. 4-2 were exposed using light sources shown in Table 1 and the obtained images were evaluated with respect to contrast (γ), density (D) obtained at 5% dot exposure, linearity and residual dye stain, in accordance with the procedure described below.

Exposure

Using a cylindrical image setter of an inventor's own design, the foregoing nine samples were exposed to the seven kinds of light shown in Table 1. Thus, exposure was conducted using infrared LD (laser diode) at an exposure wavelength of 810 and 780 nm, a red LED at 660 nm, an argon laser at 488 nm and 410 nm LD used in Basys UV setter at 410 nm. Electrodeless lamp AEL, product by DAINIPPON SCREEN MFG. CO., LTD. and mercury lamp CHM-1000, product by DAINIPPON SCREEN MFG. CO., LTD. used in room-light handling printers (and also LED and UV light) each were condensed and fed into an optical fiber so as to expose the photothermographic material. Each of the samples was subjected to overall exposure or halftone dot exposure at a theoretical dot area ratio of 5%, 50% or 90%.

Processing

Exposed samples were thermally processed using Kodak Dry View Processor 2771 at a line speed of 25 mm, a preheating temperature of 110° C. and a developing temperature of 123° C. for 19 sec.

Determination of γ

Contrast (γ) was defined a slope of a straight line connecting two points corresponding to densities of 0.8 and 2.5 on the characteristic curve.

Density (D) at 5% Dot Exposure

When exposed under the condition that exposure at a theoretical dot area ratio of 5% produced a 5% dot (i.e., a dot having a dot area ratio of 5%), the density at the overall exposure area (denoted as D) was measured using a Macbeth densitometer. In this case, the halftone dot area ratio was determined by X-Rite.

Linearity When exposed under the condition that exposure at a theoretical dot area ratio of 5% produced a 5% dot (i.e., a dot having a dot area ratio of 5%), the dot area of a dot produced by exposure at a theoretical dot area of 90% was determined by X-Rite and represented as linearity. The closer the linearity is to 90% is better.

Measurement of Residual Dye Staining

The unexposed area of each of the processed samples was visually evaluated, and ranked 0 to 5.0, in which 5.0 was a level on no observed residual dye stain; 4.0 was a level of slightly observed stains, 3.0 was a level acceptable in practical use but pointed out by users; 2.0 was a level pointed out by many users; and 1.0 was a level of being problems in practical use.

Example 2

Preparation of Sample Nos. 9 through 17

Samples No. 9 and 10 were prepared similarly to Sample No. 1, except that the preparation of light-sensitive silver halide emulsion B was varied as below. Thus the addition time of remaining solution (B1) and the total amount of solution (D1), while being controlled at a temperature of 45° C. and a pAg of 8.09 was varied from 14 min 15 sec to 10 min at 45° C. or 8 min at 35° C., so that silver halide grains having an average grain size of 0.05 μm or 0.03 μm were obtained. Similarly to sample No. 1 of Example 1 were prepared sample No. 9 (using silver halide grains having an average size of 0.05 μm) and sample No. 10 (using silver halide grains having an average size of 0.03 μm).

Sample No. 11 was prepared similarly to sample No. 9, except that silver halide grains used in sample No. 9 were not used.

Sample No. 12 was prepared similarly to sample No. 9, except that sensitizing dye solution (a) was replaced by sensitizing dye solution (b).

Sample No. 13 was prepared similarly to sample No. 12, except that silver halide grains were varied to those having an average size of 0.03 μm.

Sample No. 14 was prepared similarly to sample No. 12, except that silver halide grains used in sample No. 12 were not used.

Sample No. 15 was prepared similarly to sample No. 9, except that sensitizing dye solution (a) was not added.

Sample No. 16 was prepared similarly to sample No. 15, except that silver halide grains were varied to those having an average size of 0.03 μm.

Sample No. 17 was prepared similarly to sample No. 15, except that silver halide grains used in sample No. 15 were not used.

The thus prepared samples No. 9 through 17 were each evaluated, similarly to Example 1, with respect to γ-value, density (D) when subjected to 5% half tone dot exposure, linearity and remaining dye stain, provided that the exposure condition at the exposure wavelengths shown in Table 2 was employed. Results are shown in Table 2.

Example 3

Preparation of Sample Nos. 18 through 23

Sample No. 18 was prepared similarly to Sample No. 9 of Example 2, provided that the composition of back layer coating solution 3 described earlier was varied as below. Thus, subsequent to methyl ethyl ketone used in the back layer coating solution, comparative dye 1 in an amount giving an optical density at 780 nm of 0.8 and triphenylguanidine in an equimolar amount to comparative dye 1 were further added, and comparative dye 1 was added to additive solution (a), in an amount giving an optical density of 0.1 at 780 nm.

Comparative dye 1

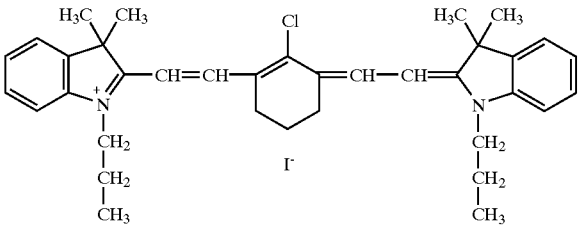

Sample No. 19 was prepared similarly to sample No. 18, except that silver halide grains were varied to those having an average size of 0.03 μm.

Sample No. 20 was prepared similarly to sample No. 18, except that silver halide grains used in sample No. 18 were not used.

Sample No. 21 was prepared similarly to sample No. 18, except that comparative dye 1 was replaced by compound I-1 (UV absorbent) as shown in Table 3.

Sample No. 22 was prepared similarly to sample No. 21, except that silver halide grains were varied to those having an average size of 0.03 μm.

Sample No. 23 was prepared similarly to sample No. 21, silver halide grains used in sample No. 21 were not used.

Image Evaluation

The thus prepared samples No. 18 through 23 were each evaluated, similarly to Example 1, with respect to □-value, density (D) when subjected to 5% half tone dot exposure, linearity, absorbance at the wavelength of 400 nm of thermally processed samples and remaining dye stain, provided that the exposure condition at the exposure wavelengths shown in Table 3 was employed. Results are shown in Table 3. The absorbance at the wavelength of 400 nm of thermally processed samples (denoted as "400 nm Abs.") was measured using an absorption spectrometer, produced by Hitachi, Ltd.

TABLE 1

| Test No. | Sample No. | Sensitivity Maximum (nm) | Exposure Wavelength (nm) | Residual Solvent Content (mg/m$^2$) | γ | D | Linearity | Remaining Dye Stain | Remark |
|---|---|---|---|---|---|---|---|---|---|
| 1 | 1 | 785 | 810 | 20 | 14.0 | 4.3 | 98.0 | 4.0 | Comp. |
| 2 | 1 | 785 | 780 | 20 | 14.2 | 4.3 | 98.2 | 4.0 | Comp. |
| 3 | 2 | 665 | 660 | 25 | 14.1 | 4.2 | 99.0 | 3.0 | Comp. |
| 4 | 3 | 490 | 488 | 22 | 14.0 | 4.3 | 97.2 | 3.5 | Comp. |
| 5 | 4 | 405 | 410 | 200 | 17.1 | 4.6 | 94.0 | 4.5 | Inv. |
| 6 | 4 | 405 | AEL | 200 | 17.5 | 4.7 | 94.2 | 4.5 | Inv. |
| 7 | 4 | 405 | CHM-1000 | 200 | 17.3 | 4.8 | 94.3 | 4.5 | Inv. |
| 8 | 5 | 782 | 810 | * | 13.2 | 4.2 | 97.8 | 4.0 | Comp. |
| 9 | 5 | 782 | 780 | * | 14.0 | 4.1 | 98.0 | 4.0 | Comp. |
| 10 | 6 | 662 | 660 | * | 14.0 | 4.2 | 98.9 | 3.0 | Comp. |
| 11 | 7 | 483 | 488 | * | 14.2 | 4.1 | 97.5 | 3.5 | Comp. |
| 15 | 4-2 | 405 | CHM-1000 | 200 | 5.0 | 2.8 | 95.0 | 4.4 | Comp. |

*less than 1 mg/m$^2$

AEL: electrodeless lamp having a main emission at 360 to 440 nm

CHM-1000: mercury lamp having a main emission at 360 to 440 nm.

TABLE 2

| Test No. | Sample No. | Sensitivity Maximum (nm) | Exposure Wavelength (nm) | Residual Solvent Content (mg/m$^2$) | Av. AgX Grain size (μm) | γ | D | Linearity | Remaining Dye Stain | Remark |
|---|---|---|---|---|---|---|---|---|---|---|
| 1 | 9 | 785 | 780 | 20 | 0.05 | 15.0 | 4.3 | 98.0 | 4.0 | Comp. |
| 2 | 10 | 784 | 780 | 22 | 0.03 | 15.3 | 4.3 | 97.8 | 4.0 | Comp. |
| 3 | 11 | 785 | 780 | 18 | — | 13.0 | 3.5 | 97.0 | 4.0 | Comp. |
| 4 | 12 | 663 | 660 | 17 | 0.05 | 15.1 | 4.2 | 99.0 | 3.0 | Comp. |
| 5 | 13 | 663 | 660 | 20 | 0.03 | 15.4 | 4.2 | 98.8 | 3.0 | Comp. |
| 6 | 14 | 662 | 660 | 16 | — | 13.2 | 3.4 | 98.7 | 3.0 | Comp. |
| 7 | 15 | 405 | 410 | 180 | 0.05 | 17.5 | 4.9 | 94.0 | 4.5 | Inv. |
| 8 | 16 | 405 | 410 | 190 | 0.03 | 18.0 | 4.9 | 93.8 | 4.5 | Inv. |
| 9 | 17 | 404 | 410 | 150 | — | 18.3 | 5.0 | 93.4 | 4.5 | Inv. |
| 10 | 15 | 405 | AEL | 180 | 0.05 | 17.8 | 4.7 | 94.2 | 4.5 | Inv. |
| 11 | 16 | 405 | AEL | 190 | 0.03 | 18.1 | 4.8 | 94.0 | 4.5 | Inv. |
| 12 | 17 | 404 | AEL | 150 | — | 18.5 | 4.8 | 93.8 | 4.5 | Inv. |
| 13 | 15 | 405 | CHM-1000 | 180 | 0.05 | 17.7 | 4.8 | 94.3 | 4.5 | Inv. |
| 14 | 16 | 405 | CHM-1000 | 190 | 0.03 | 18.3 | 4.8 | 94.0 | 4.5 | Inv. |
| 15 | 17 | 404 | CHM-1000 | 150 | — | 18.5 | 4.9 | 93.8 | 4.5 | Inv. |

TABLE 3

| Test No. | Sample No. | Sensitivity Maximum (nm) | Exposure Wavelength (nm) | Average Size of AgX Grains (μm) | Dye or UV Absorbent | γ | D | Linearity | 400 nm Abs. | Remaining Dye Stain | Remark |
|---|---|---|---|---|---|---|---|---|---|---|---|
| 1 | 18 | 785 | 780 | 0.05 | Comparative dye 1 | 16.0 | 4.2 | 97.8 | 0.38 | 3.5 | Comp. |
| 2 | 19 | 784 | 780 | 0.03 | Comparative dye 1 | 16.1 | 4.2 | 97.7 | 0.38 | 3.5 | Comp. |
| 3 | 20 | 785 | 780 | — | Comparative dye 1 | 12.0 | 3.0 | 97.2 | 0.37 | 3.5 | Comp. |
| 4 | 21 | 406 | 410 | 0.05 | Exemplified compound I-1 | 18.8 | 4.9 | 93.5 | 0.20 | 4.5 | Inv. |
| 5 | 22 | 405 | 410 | 0.03 | Exemplified compound I-1 | 19.0 | 4.9 | 93.0 | 0.19 | 4.5 | Inv. |
| 6 | 23 | 405 | 410 | — | Exemplified compound I-1 | 19.1 | 5.0 | 92.9 | 0.18 | 4.5 | Inv. |
| 7 | 21 | 406 | AEL | 0.05 | Exemplified compound I-1 | 19.3 | 5.0 | 94.0 | 0.20 | 4.5 | Inv. |
| 8 | 22 | 405 | AEL | 0.03 | Exemplified compound I-1 | 20.0 | 5.1 | 93.6 | 0.19 | 4.5 | Inv. |
| 9 | 23 | 405 | AEL | — | Exemplified compound I-1 | 20.5 | 5.1 | 93.2 | 0.18 | 4.5 | Inv. |
| 10 | 21 | 406 | CHM-1000 | 0.05 | Exemplified compound I-1 | 19.5 | 5.1 | 93.9 | 0.20 | 4.5 | Inv. |
| 11 | 22 | 405 | CHM-1000 | 0.03 | Exemplified compound I-1 | 20.1 | 5.2 | 93.7 | 0.19 | 4.5 | Inv. |
| 12 | 23 | 405 | CHM-1000 | — | Exemplified compound I-1 | 20.3 | 5.2 | 93.4 | 0.18 | 4.5 | Inv. |

As can be seen from Tables 1 to 3, when subjected to halftone exposure using a short-wave light of 350 to 450 nm and then to thermal developement to perform image formation, inventive samples led to images exhibiting high contrast (γ) and high density (D) at 5% halftone exposure, superior linearity, and minimized residual dye stain. Contrary to that, comparative samples resulted in images inferior in γ, density at 5% halftone exposure, linearity and staining.

What is claimed is:

1. A photothermographic material comprising on a support an organic silver salt, silver halide grains, a reducing agent, a contrast-increasing agent and a binder, wherein the photothermographic material contains a residual organic solvent of 30 to 500 mg/m$^2$ and exhibits a sensitivity maximum at a wavelength of 350 to 450 nm.

2. The photothermographic material of claim 1, wherein the residual organic solvent is 100 to 300 mg/m$^2$.

3. The photothermographic material of claim 1, wherein the silver halide grains have an average grain size of not more than 0.03 μm.

4. The photothermographic material of claim 1, wherein the photothermographic material comprises a compound represented by the following formula (I) to (III):

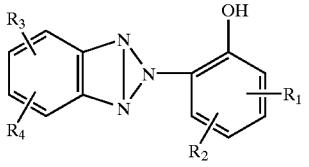

wherein $R_1$ through $R_4$ are each a hydrogen atom, halogen atom, nitro group, hydroxy group, alkyl group, alkoxy group, aryl group, aryloxy group, acylamino group, carbamoyl group, sulfo group, alkylthio group or arylthio group, provided that $R_1$ and $R_2$, or $R_3$ and $R_4$ may combine with each other to form a ring;

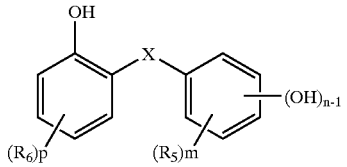

wherein $R_5$ and $R_6$ are each a hydrogen atom, alkyl group or acyl group; X is —CO— or —COO—; m, n and p are each an integer of 1 to 4;

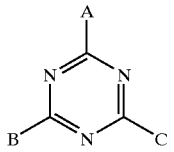

wherein A, B and C are each an alkyl group, aryl group, alkoxy group, aryloxy group or heterocyclic group, provided that at least one of A, B and C is represented by the following formula (IV):

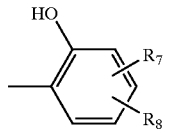

wherein $R_7$ and $R_8$ are each a hydrogen atom, or an alkyl group, aryl group, alkoxy group or aryloxy group.

5. The photothermographic material of claim 4, wherein the photothermographic material further comprises a decolorizing agent.

6. An image formation method comprising exposing a photothermographic material comprising on a support an organic silver salt, silver halide grains, a reducing agent, a contrast-increasing agent and a binder, and subjecting the exposed photothermographic material to thermal development to form images, wherein the photothermographic material contains a residual organic solvent of 30 to 500 mg/m$^2$ and exhibits a sensitivity maximum at a wavelength of 350 to 450 nm, and wherein the photothermographic material is exposed to a light exhibiting an emission maximum at a wavelength of 350 to 450 nm.

7. The image formation method of claim 6, wherein the light has an emission maximum at 370 to 420 nm.

8. The image formation process of claim 6, wherein the light is an incoherent light.

9. The image formation method of claim 6, wherein the residual organic solvent is 100 to 300 mg/m$^2$.

10. The image formation method of claim 6, wherein the silver halide grains have an average grain size of not more than 0.03 nm.

11. The image formation method of claim 6, wherein the photothermographic material comprises a compound represented by the following formula (I) to (III):

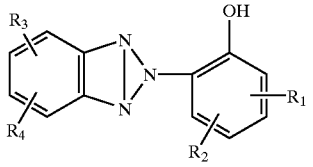

wherein $R_1$ through $R_4$ are each a hydrogen atom, halogen atom, nitro group, hydroxy group, alkyl group, alkoxy group, aryl group, aryloxy group, acylamino group, carbamoyl group, sulfo group, alkylthio group or arylthio group, provided that $R_1$ and $R_2$, or $R_3$ and $R_4$ may combine with each other to form a ring;

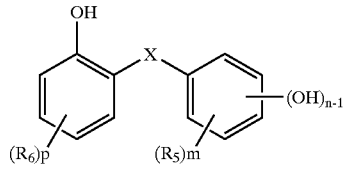

wherein $R_5$ and $R_6$ are each a hydrogen atom, alkyl group or acyl group; X is —CO— or —COO—; m, n and p are each an integer of 1 to 4;

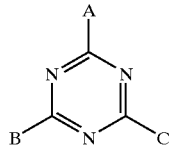

wherein A, B and C are each an alkyl group, aryl group, alkoxy group, aryloxy group or heterocyclic group, provided that at least one of A, B and C is represented by the following formula (IV):

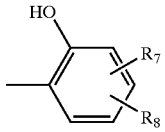

wherein $R_7$ and $R_8$ are each a hydrogen atom, or an alkyl group, aryl group, alkoxy group or aryloxy group.

12. The image formation method of claim 11, wherein the photothermographic material further comprises a decolorizing agent.

* * * * *